US007597525B2

(12) United States Patent
McMahon et al.

(10) Patent No.: US 7,597,525 B2
(45) Date of Patent: Oct. 6, 2009

(54) TILTLESS BULK MATERIAL CARGO CONTAINER LINER SYSTEM FOR USE WITH BULK MATERIAL CARGO CONTAINERS

(75) Inventors: Michael J. McMahon, Palatine, IL (US); Stanley Piotrowski, Addison, IL (US); Douglas Miller, Kingwood, TX (US); Oswaldo Mino, Houston, TX (US); Shelley Stopper, Houston, TX (US)

(73) Assignee: Illinois Tool Works Inc., Glenview, IL (US)

( * ) Notice: Subject to any disclaimer, the term of this patent is extended or adjusted under 35 U.S.C. 154(b) by 388 days.

(21) Appl. No.: 10/800,765

(22) Filed: Mar. 16, 2004

(65) Prior Publication Data

US 2005/0207878 A1 Sep. 22, 2005

(51) Int. Cl.
*B60P 1/00* (2006.01)

(52) U.S. Cl. ..... 414/539; 414/467; 414/304; 414/292; 414/287; 406/145; 406/151; 406/175; 141/65; 222/464.2; 222/464.5

(58) Field of Classification Search ..... 414/467, 414/287, 292, 304, 306, 332, 539; 406/151, 406/152, 145, 175; 141/65, 384; 222/195, 222/464.2, 464.5
See application file for complete search history.

(56) References Cited

U.S. PATENT DOCUMENTS 2,931,523 A * 4/1960 Nelligan ..... 414/539
3,139,998 A * 7/1964 Seaman ..... 414/539
3,170,600 A 2/1965 Pierson
3,527,503 A * 9/1970 Mundinger ..... 406/129
3,675,975 A * 7/1972 Mundinger et al. ..... 406/119
4,143,796 A 3/1979 Williamson et al.
4,479,243 A 10/1984 Derby et al.
4,541,765 A 9/1985 Moore
4,729,146 A * 3/1988 Barr ..... 15/303
4,884,722 A 12/1989 Podd
5,037,246 A * 8/1991 Okano et al. ..... 406/152
5,040,693 A 8/1991 Podd, Sr. et al.
5,137,170 A 8/1992 Matias
5,152,735 A 10/1992 Podd, Jr. et al.
5,193,710 A 3/1993 Podd, Sr. et al.
5,195,852 A * 3/1993 Malugani et al. ..... 406/153
5,222,621 A 6/1993 Matias
5,340,218 A 8/1994 Cuthbertson
5,421,476 A 6/1995 Matias
5,489,037 A 2/1996 Stopper (Continued)

FOREIGN PATENT DOCUMENTS

EP 1101712 5/2001

(Continued)

*Primary Examiner*—Michael S Lowe
(74) *Attorney, Agent, or Firm*—Law Offices of Steven W. Weinrieb

(57) ABSTRACT

A bulk material cargo container liner system comprises an inflatable bulk material cargo container liner which has at least one vacuum discharge tube member disposed internally within the bulk material cargo container liner and extending along the longitudinal extent thereof for discharging bulk cargo material outwardly from the bulk material cargo container liner, and at least one inflatable air bag component for conducting the bulk material, disposed within the bulk material cargo container, toward the vacuum discharge tube member.

23 Claims, 22 Drawing Sheets

U.S. PATENT DOCUMENTS

| | | | | | |
|---|---|---|---|---|---|
| 5,494,394 | A | | 2/1996 | Podd et al. | |
| 5,511,681 | A | | 4/1996 | Podd | |
| 5,529,177 | A | | 6/1996 | Podd et al. | |
| 5,542,563 | A | | 8/1996 | Matias | |
| 5,657,896 | A | | 8/1997 | Matias | |
| 5,685,688 | A | * | 11/1997 | Podd et al. | 414/539 |
| 5,699,838 | A | * | 12/1997 | Catallo et al. | 141/65 |
| 5,890,611 | A | | 4/1999 | Podd | |
| 6,207,592 | B1 | | 3/2001 | Nickell | |
| 6,250,488 | B1 | | 6/2001 | Narahara et al. | |

FOREIGN PATENT DOCUMENTS

| | | |
|---|---|---|
| EP | 1386859 | 2/2004 |
| WO | WO 85/04637 | 10/1985 |
| WO | WO 88/09755 | 12/1988 |

* cited by examiner

TILTLESS BULK MATERIAL CARGO CONTAINER LINER SYSTEM FOR USE WITH BULK MATERIAL CARGO CONTAINERS

FIELD OF THE INVENTION

The present invention relates generally to bulk material cargo containers within which fluid-like or flowable cargo materials, such as, for example, dry bulk chemicals, resins in powdered, flaked, and pelletized forms, coffee beans, flour, grains, rice, sugar or the like, are normally housed or contained while being shipped or transported, and more particularly to a new and improved bulk material cargo container liner system, for use in conjunction with such bulk material cargo containers, wherein the new and improved bulk material cargo container liner system not only enables or permits the bulk material cargo container to be utilized as a bulk material storage bin or silo, but in addition, facilitates the discharge of the bulk material cargo load from the bulk material cargo container in accordance with operational techniques which do not require the bulk material cargo container to be moved into a tilted mode, as is normally performed or conducted in accordance with conventional or PRIOR ART bulk material cargo load discharge techniques in order to effectively discharge the entire bulk material cargo load from the bulk material cargo container, but to the contrary, achieves such discharge of the bulk material cargo load from the bulk material cargo container as a result of effectively altering the angle of repose of the bulk material disposed within the bulk material cargo container.

BACKGROUND OF THE INVENTION

Bulk material cargo containers are conventionally used, at different times, to house or contain different fluid-like or flowable bulk cargo materials, such as, for example, dry bulk chemicals, resins in powdered, flaked, and pelletized forms, flour, coffee beans, grains, rice, sugar, and the like, while the bulk cargo materials are being shipped or transported from one location to another by means of, for example, ship, truck, railroad, and the like. Since different bulk cargo materials are shipped or transported within particular bulk material cargo containers at different times, it is imperative that the bulk material cargo containers effectively be clean so as not to contaminate the bulk cargo materials comprising a particular bulk material cargo load with residual bulk cargo materials which may remain within the bulk material cargo container from a previously shipped or transported bulk material cargo load. Accordingly, in order to eliminate the normally necessary cleaning of each bulk material cargo container hold after a particular bulk material cargo load has been unloaded or discharged from a particular one of the bulk material cargo container holds, it has become conventional within the industry to employ removable bulk material cargo container liners within the cargo holds of the bulk material cargo containers wherein, after a particular bulk material cargo load has been delivered to its destination and discharged or unloaded, the bulk material cargo container liner is simply removed from the bulk material cargo container whereby the bulk material cargo container is again useable, without a significant amount of cleaning being required, for carrying another bulk material cargo load typically comprising fluid or flowable bulk cargo material. Bulk material cargo containers, having bulk material cargo container liners disposed therein for shipping or transporting fluid or flowable bulk cargo materials, may be found, for example, within U.S. Pat. No. 5,657,896 which issued on Aug. 19, 1997 to Matias, U.S. Pat. No. 5,542,563 which issued on Aug. 6, 1996 to Matias, U.S. Pat. No. 5,489,037 which issued on Feb. 6, 1996 to Stopper, U.S. Pat. No. 5,421,476 which issued on Jun. 6, 1995 to Matias, U.S. Pat. No. 5,222,621 which issued on Jun. 29, 1993 to Matias, U.S. Pat. No. 5,193,710 which issued on Mar. 16, 1993 to Podd, Sr. et al., U.S. Pat. No. 5,152,735 which issued on Oct. 6, 1992 to Podd, Jr. et al., U.S. Pat. No. 5,137,170 which issued on Aug. 11, 1992 to Matias, U.S. Pat. No. 4,884,722 which issued on Dec. 5, 1989 to Podd, and U.S. Pat. No. 4,541,765 which issued on Sep. 17, 1985 to Moore.

In connection with the aforenoted use of bulk material cargo container liners within bulk material cargo containers, it is noted that conventionally, bulk material cargo container liners are provided with an upper intake port through which the bulk cargo material is conducted into the bulk material cargo container liner, and a lower discharge port through which the bulk cargo material is discharged or exhausted outwardly from the bulk material cargo container liner. When the bulk cargo material is in fact to be discharged from the bulk material cargo container liner, the discharge port is opened, and gravitational forces will initially cause the bulk cargo material to naturally and automatically flow outwardly through the discharge port of the bulk material cargo container liner. This procedure will continue until the bulk cargo material reaches or attains its natural angle of repose, as determined along the slide surface of the bulk cargo material, at which point in time the various forces acting upon the bulk cargo material will effectively be equal and opposite to each other so as to attain or define a state of equilibrium whereby the bulk cargo material will be disposed in a static state and will no longer be able to flow. More particularly, for example, the vector of gravity which is operating or oriented along the slide surface of the bulk cargo material, so as to accordingly act upon the bulk cargo material in order to normally cause the bulk cargo material to naturally or automatically flow, will effectively be counteracted by means of other force vectors inherent to or characteristic of the bulk cargo material, such as, for example, conglomeration forces, nesting forces, frictional forces, shear forces, and the like.

The nesting or shear forces are or may be determined, for example, by means of the size, shape, and density characteristics of the bulk cargo material, whereas the conglomeration forces are or may be determined, for example, by means of moisture, additives, and other characteristics of the bulk cargo material. It can therefore be further appreciated that when the angle of the slide surface of the bulk cargo material, along which the bulk cargo material will normally flow, is equal to or less than the aforenoted angle of equilibrium, or in other words, the angle of repose of the bulk cargo material, the bulk cargo material will remain static and will not flow due to the fact that the force vector of gravity operating or oriented along the slide surface of the bulk cargo material is in fact sufficiently counteracted by means of the other aforenoted force vectors similarly operating or oriented along the slide surface of the bulk cargo material. Conversely, when the angle of the slide surface of the bulk cargo material, along which the bulk cargo material will normally flow, is greater than the aforenoted angle of equilibrium or the angle of repose of the bulk cargo material, the bulk cargo material will become dynamic and will in fact flow due to the fact that the force vector of gravity operating or oriented along the slide surface of the bulk cargo material is now in fact greater than, overcomes, or exceeds the other aforenoted force vectors similarly operating or oriented along the slide surface of the bulk cargo material.

Conventionally, the most common manner by means of which the aforenoted flowability characteristics of the bulk cargo material can be affected, altered, or adjusted, is to cause the bulk cargo container to undergo a tilting operation by means of which, for example, the front end of the bulk material cargo container is lifted to an elevational level which is higher than the back or rear end of the bulk material cargo container. More particularly, when a particular bulk material cargo container, carrying a particular bulk cargo material, undergoes a predetermined amount or degree of tilt, the particular bulk cargo material will once again begin to flow under the influence of gravity, and may accordingly be conducted toward the discharge port of the bulk material cargo container, because the angle of the slide surface of the bulk cargo material, or in other words, the angle of incline or decline, is now greater than or exceeds the angle of repose of the bulk cargo material such that the vector of gravity, operating or oriented along the slide surface of the bulk cargo material has effectively been increased so as to be greater than, exceed, or overcome the aforenoted nesting, frictional, shear, and conglomeration force vectors. It has been experienced, however, that the implementation of such bulk material cargo container tilting operations is not always easily or readily able to be accomplished, particularly in a cost-effective manner.

Normally, for example, in order to comprise economically viable bulk material cargo transportation, delivery, and distribution systems, the systems comprise an operative integration of bulk material cargo container transportation facilities, such as, for example, rail hopper cars or a fleet of bulk material cargo container tractor-trailer trucks, sea-going bulk material cargo container ships, and the like. In addition, bulk material cargo container tilt apparatus or mechanisms are conveniently or viably positioned at predetermined locations adjacent to or near the bulk material cargo container transportation facilities for operatively handling the aforenoted rail-hopper cars, tractor-trailer trucks, and ship containers in order to discharge or unload the bulk material cargo loads carried thereby. Still further, silo or other similar bulk material storage facilities are also conveniently or viably positioned at predetermined locations with respect to the aforenoted transportation and handling facilities so as to be capable of storing the unloaded bulk material cargo loads in preparation for, or in conjunction with, the distribution of such bulk material to end user customers. Unfortunately, as may be readily appreciated, the construction and operation of such an integrated transportation, handling, and distribution system is relatively expensive. Accordingly, it is only economically viable for such integrated transportation, delivery, and distribution systems to be constructed and operated by relatively large-sized companies located primarily within highly-industrialized nations. Therefore, it is appreciated still further that relatively medium-sized and small-sized companies are not able to viably compete economically with such relatively large-sized companies in view of the fact that such medium-sized and small-sized do not have access to, or the economic resources to construct and operate, the aforenoted integrated bulk material cargo container transportation and handling facilities, or the bulk material storage and distribution facilities.

At best, if such relatively medium-sized and small-sized companies nevertheless desire to engage in bulk material cargo load transportation, handling, and distribution businesses, and try to be competitive with the relatively large-sized companies, they are often forced to lease necessary services or facilities from the relatively large-sized companies which, again, is not economically advantageous. However, if a bulk material cargo container system could be developed wherein tilt-type handling apparatus or systems were no longer necessary for discharging or unloading the bulk material cargo load from the bulk material cargo containers, or in addition, if apparatus or systems could likewise be developed wherein auxiliary silo-type storage facilities were likewise no longer necessary for storing and distributing bulk material cargo loads from bulk material cargo containers, then the relatively medium-sized and small-sized companies could enjoy the economic advantages to be derived from bulk material cargo load transportation, handling, and distribution systems. The relatively medium-sized and small-sized companies could therefore in fact viably compete economically with the relatively large-sized companies.

A need therefore exists in the art for a new improved bulk material cargo container liner system, for use within bulk material cargo containers, wherein tilt-type handling apparatus would no longer be necessary for unloading or discharging bulk material cargo loads from bulk material cargo containers, and in addition, a new and improved bulk material cargo container liner system, for use within bulk material cargo containers, wherein auxiliary silo-type storage facilities would likewise no longer be necessary for storing and distributing bulk material cargo loads from bulk material cargo containers, whereby relatively medium-sized and small-sized companies can enjoy the economic advantages to be derived from bulk material cargo load transportation, handling, and distribution systems such that the relatively medium-sized and small-sized companies can in fact viably compete economically with the relatively large-sized companies.

SUMMARY OF THE INVENTION

The aforenoted need is resolved in accordance with the teachings and principles of the present invention as a result of the provision of a new and improved bulk material cargo container liner system, for use within bulk material cargo containers, wherein, in accordance with one embodiment of the new and improved bulk material cargo container liner system, an inflatable bulk material cargo container liner has a pair of inflatable air bags or compartments integrally connected thereto or associated therewith. The inflatable air bags or compartments can be located externally of, or internally within, the bulk material cargo container liner, and may comprise various cross-sectional configurations, such as, for example, being substantially triangular in cross-section, or alternatively, comprising a plurality of inflatable air bags having substantially circular cross-sectional configurations but being integrally connected together such that the overall cross-sectional configuration is substantially triangular. In either case, the inflatable air bag or compartment assemblies will have substantially right triangular configurations when disposed in their inflated states such that hypotenuse portions of the inflatable air bags or compartments will effectively be inclined with respect to the bottom or lower surface portion of the bulk material cargo container liner. The inflatable air bags are preferably disposed, for example, within the oppositely disposed, laterally spaced, longitudinally extending lower corner regions of the bulk material cargo container liner, and may be operatively associated with a vacuum tube assembly which may be located along the longitudinal centerline of the bulk material cargo container liner. In this manner, when the air bags or compartments are inflated, the angled hypotenuse portions of the air bags or compartments will effectively act upon the bulk cargo material disposed within the bulk material cargo container liner so as to effectively alter the incline angle of the slide surface of the bulk cargo material such that the slide surface of the bulk cargo material effectively attains an angle which is greater than the angle of repose of the bulk cargo material whereby the bulk cargo material can once again dynamically flow and be discharged out from the bulk material cargo container liner through means of the vacuum tube assembly.

Alternatively, in accordance with another embodiment of the present invention, a pair of vacuum tube assemblies can be disposed at predetermined laterally or transversely spaced positions along the bottom or floor portion of the bulk material cargo container liner, and a third inflatable air bag or compartment assembly, having a substantially isosceles triangle cross-sectional configuration, will be located along the centerline of the bulk material cargo container liner. Accordingly, the centrally located inflatable air bag or compartment assembly operatively cooperates with the first two inflatable air bag or compartment assemblies located within the corner regions of the bulk material cargo container liner so as to cause the bulk cargo material to be moved toward both of the laterally spaced vacuum tube assemblies. Alternatively still further, in accordance with yet another embodiment of the present invention, a pair of laterally spaced vacuum tube assemblies are located within the oppositely disposed, laterally spaced corner regions of the bulk material cargo container liner while a single inflatable air bag or compartment assembly, having a substantially isosceles triangular configuration, is located along the longitudinal centerline of the bulk material cargo container liner whereupon inflation of the single inflatable air bag or compartment assembly, the bulk cargo material will be forced toward the laterally spaced vacuum tube discharge assemblies.

BRIEF DESCRIPTION OF THE DRAWINGS

Various other features and attendant advantages of the present invention will be more fully appreciated from the following detailed description when considered in connection with the accompanying drawings in which like reference characters designate like or corresponding component parts throughout the several views, and wherein:

FIG. 3, is utilized in conjunction with a pair of laterally spaced vacuum discharge tube assemblies disposed within the corner regions of the bulk material cargo container liner, however, the single inflatable air bag component is disposed externally of the bulk material cargo container liner and is illustrated in its inflated state;

DETAILED DESCRIPTION OF THE PREFERRED EMBODIMENT

As has been noted hereinbefore, in order to discharge or unload a bulk material cargo load or contents from a bulk material cargo container liner, the bulk material cargo container, within which the bulk material cargo container liner is disposed, normally needs to be tilted, however, in accordance with the teachings and principles of the present invention, the need for tilting the bulk material cargo container, in order to discharge or unload the bulk material cargo load or contents therefrom, is obviated or rendered unnecessary. More particularly, if tilting of the bulk material cargo container is to be obviated, means must nevertheless be provided in order to cause the bulk material cargo load or contents to experience its requisite movement or flowability toward the discharge or unloading port so as to in fact be able to be discharged or unloaded from the bulk material cargo container liner. In accordance then with the particular principles and teachings of the present invention, the bulk material cargo container liner has integrally incorporated therein at least one vacuum discharge tube assembly and a plurality of inflatable air bag components wherein the inflatable air bag components are adapted to be inflated by means of, for example, suitable valve structures, not shown, which are adapted to be fluidically connected to suitable inflation and deflation control means, also not shown, so as to operatively control the movement of the bulk cargo material toward the vacuum discharge tube assemblies.

Figure 1:
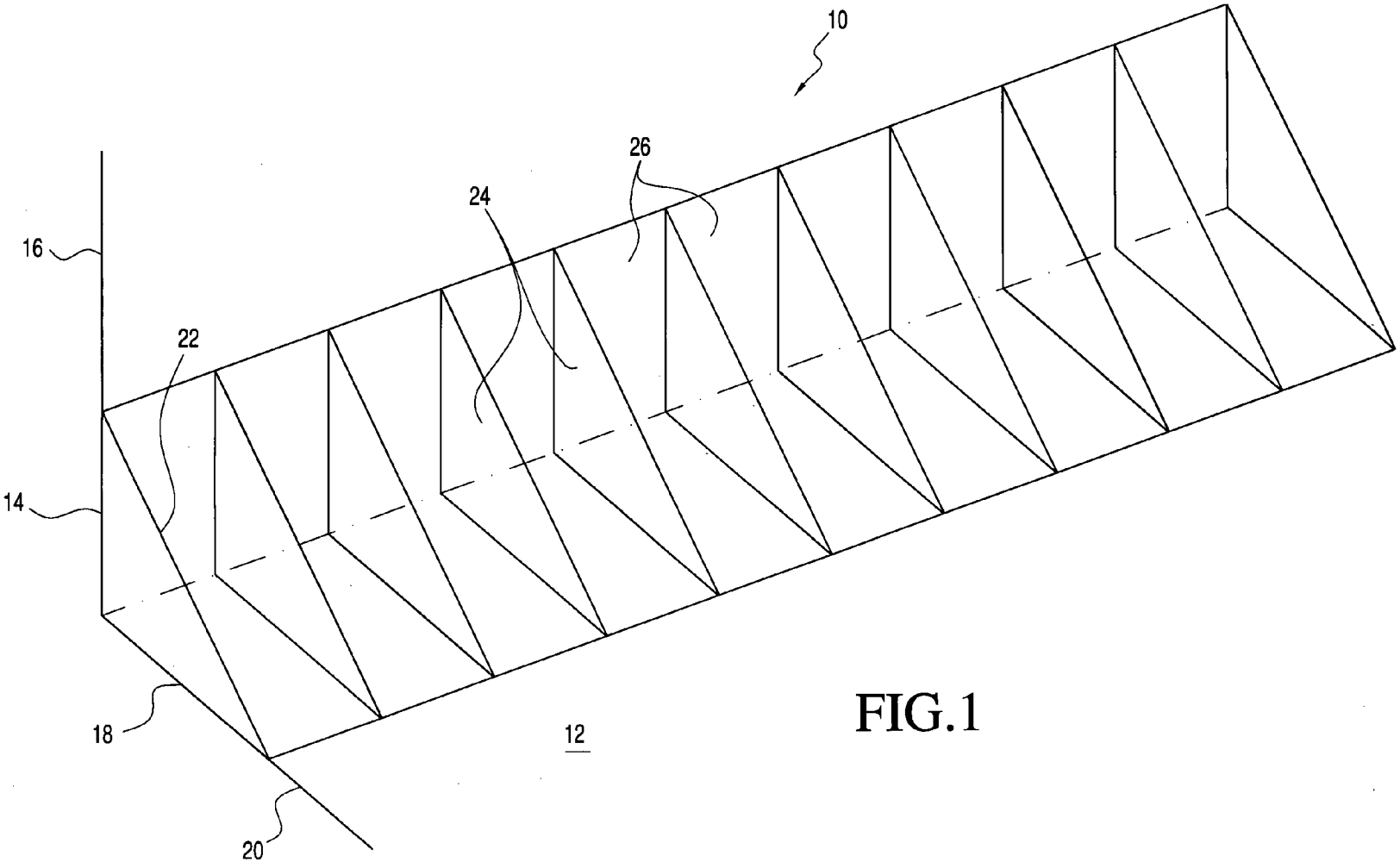
FIG. 1 is a schematic perspective view of a first embodiment of a new and improved inflatable air bag component which has been constructed in accordance with the principles and teachings of the present invention so as to have a substantially right-triangular cross-sectional configuration, and which is adapted to be utilized in conjunction with a new and improved bulk material cargo container liner of the present invention so as to facilitate the discharge or unloading of bulk cargo materials from the bulk material cargo container liner and the bulk material cargo container without necessitating any operative tilting of the bulk material cargo container.

Referring then to the drawings, and more particularly to FIG. 1 thereof, a first embodiment of a new and improved inflatable air bag component, which has been constructed in accordance with the principles and teachings of the present invention, and which is adapted to be utilized within a corner region of a new and improved bulk material cargo container liner assembly which has also been constructed in accordance with the principles and teachings of the present invention, so as to facilitate the discharge or unloading of bulk cargo materials from the bulk material cargo container liner and the bulk material cargo container without necessitating any operative tilting of the bulk material cargo container, is disclosed and is generally indicated by the reference character 10. More particularly, it is seen that the new and improved inflatable air bag component 10 has a substantially right-triangular configuration. In accordance with the intended use of this particular embodiment of the inflatable air bag component 10, the inflatable air bag component 10 is adapted to be disposed internally within the bulk material cargo container liner 12 which has the configuration of a rectangular parallelepiped, as is conventionally known, such that the vertically oriented leg portion 14 of the inflatable air bag component 10 is adapted to be disposed along one vertical side wall 16 of the bulk material cargo container liner 12, while the horizontally oriented leg portion 18 of the inflatable air bag component 10 is adapted to be disposed along the bottom wall or floor portion 20 of the bulk material cargo container liner 12.

In this manner, it can be readily appreciated, in turn, that the hypotenuse portion 22 of the inflatable air bag component 10 will be disposed at a predetermined inclined angle within the interior portion of the bulk material cargo container liner 12. It is to be additionally appreciated that the inflatable air bag component 10 is adapted to extend throughout the entire longitudinal extent of the bulk material cargo container liner 12. Accordingly, when the inflatable air bag component 10 is disposed in its inflated state, the inclined hypotenuse portion 22 of the inflatable air bag component 10 will serve to effectively move the bulk cargo material, disposed within the bulk material cargo container liner 12, from the side wall and corner regions of the bulk material cargo container liner 12 toward an axially central region of the bulk material cargo container liner 12. Conversely, when the inflatable air bag component 10 is disposed in its deflated state, that is, prior to inflation for its intended use, the hypotenuse portion 22 of the inflatable air bag component 10 will effectively collapse into the internal corner region of the bulk material cargo container liner 12 as defined at the intersection of the vertical side wall portion 16 of the bulk material cargo container liner 12 and the horizontal bottom wall or floor portion 20 of the bulk material cargo container liner 12. As can be readily appreciated from well-known principles and teachings of plane geometry, the linear extent of the hypotenuse portion 22 of the inflatable air bag component 10 is less than the combined linear extents of the vertically oriented leg portion 14 of the inflatable air bag component 10 and the horizontally oriented leg portion 18 of the inflatable air bag component 10.

Therefore, it is to be noted that in order to permit or facilitate the aforenoted internal collapse of the inflatable air bag component 10 whereby the same can in fact be disposed within the corner region of the bulk material cargo container liner 12 when the inflatable air bag component 10 is to be disposed in its fully deflated state, those regions of the vertically oriented leg portion 14 of the inflatable air bag component 10 and the horizontally oriented leg portion 18 of the inflatable air bag component 10 which are located remote from the corner region of the inflatable air bag component 10 are not actually fixedly secured to the vertical side wall 16 of the bulk material cargo container liner 12 or to the bottom wall or floor portion 20 of the bulk material cargo container liner 12. It is noted further that the inflatable air bag component 10 has a plurality of axially spaced, substantially right-triangularly configured gussets 24 disposed internally within the inflatable air bag component 10 so as to not only provide internal support within the inflatable air bag component 10 throughout the entire axial extent of the same, but in addition, the plurality of gussets 24 effectively divide the entire internal region of the inflatable air bag component 10 into a plurality of axially separated cells 26. The cells 26 may comprise fluidically separated compartments so as to be inflated separately by suitable means, not shown, or alternatively, the cells 26 may be fluidically connected to each other so as to be able to be inflated simultaneously by suitable means, also not shown. The foregoing use of one or more of the inflatable air bag components within bulk material cargo container liners can be better appreciated with reference being further made to FIGS. 2-4.

Figure 2:
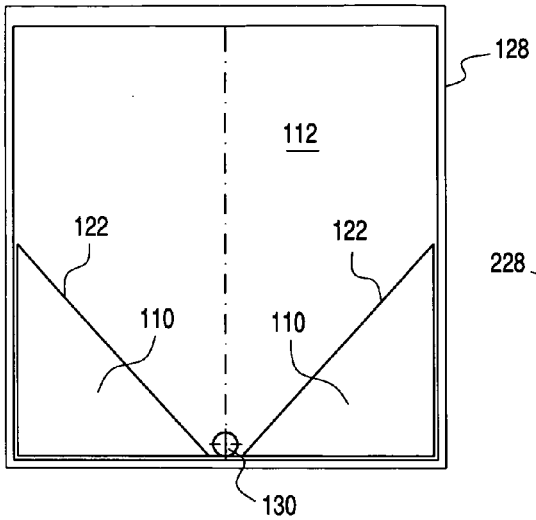
FIG. 2 is a schematic cross-sectional view of a first embodiment of a bulk material cargo container liner, disposed within a bulk material cargo container, wherein the bulk material cargo container liner has a pair of inflatable air bag components, each one of which is similar to the inflatable air bag component disclosed within FIG. 1, disposed internally within the oppositely disposed, laterally spaced corner regions of the bulk material cargo container liner such that when the inflatable air bag components are inflated, as illustrated, the bulk cargo material, disposed within the bulk material cargo container liner, will be moved toward the longitudinal centerline region of the bulk material cargo container liner so as to be discharged through means of a single vacuum discharge tube assembly located along the longitudinal centerline region of the bulk material cargo container liner.

More particularly, as illustrated within FIG. 2, a bulk material cargo container liner 112 is disposed internally within a bulk material cargo container 128, and it is seen that the bulk material cargo container liner 112 has a pair of inflatable air bag components 110, each one of which is substantially similar to the inflatable air bag component 10 as disclosed within FIG. 1, disposed internally within the oppositely disposed, laterally spaced corner regions of the bulk material cargo container liner 112. In this manner, when both of the inflatable air bag components 110 are inflated, as is illustrated, the bulk cargo material, disposed within the bulk material cargo container liner 112, will be moved toward the longitudinal centerline region of the bulk material cargo container liner 112 so as to be discharged through means of a single, axially oriented vacuum discharge tube assembly 130 which is located along the longitudinal centerline region of the bulk material cargo container liner 112 and which is fluidically connected to a suitable source of vacuum, not shown.

Figure 3:
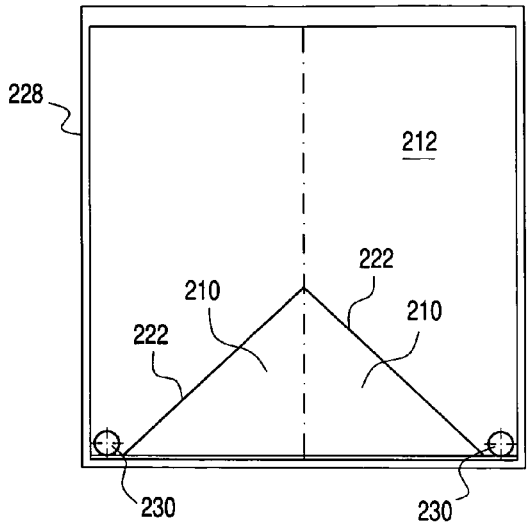
FIG. 3 is a schematic cross-sectional view, similar to that of FIG. 2, of a second embodiment of a bulk material cargo container liner disposed within a bulk material cargo container wherein, however, the bulk material cargo container liner comprises a single inflatable air bag component disposed internally within the bulk material cargo container liner so as to be disposed along the longitudinal centerline region of the bulk material cargo container liner, having a substantially isosceles triangular cross-sectional configuration, and wherein further, a pair of vacuum discharge tube assemblies are located within the oppositely disposed, laterally spaced corner regions of the bulk material cargo container liner such that when the single inflatable air bag component is inflated, as illustrated, the bulk cargo material, disposed within the bulk material cargo container liner, will be moved toward the corner regions of the bulk material cargo container liner so as to be discharged by means of the pair of vacuum discharge tube assemblies.

In a similar but somewhat alternative manner, as illustrated within FIG. 3, in lieu of the substantially right-triangular inflatable air bag components 210,210 being disposed within the oppositely disposed, laterally spaced corner regions of the bulk material cargo container liner 212 disposed internally within the bulk material cargo container 228, it is seen that the bulk material cargo container liner 212 has an inflatable air bag component which is disposed along the axially central region of the bulk material cargo container liner 212. In actuality, the inflatable air bag component may comprise a single inflatable air bag component 210 having a substantially isosceles triangular configuration and comprising a pair of inflatable air bag sections 210,210, or alternatively, the inflatable air bag component may comprise a pair of inflatable air bag components 210,210, each one of which is substantially similar to the inflatable air bag component 10 as disclosed within FIG. 1, which are disposed in a substantially back-to-back mode with respect to each other within the axially central region of the bulk material cargo container liner 212. In either case, the hypotenuse portions 222,222 of the inflatable air bag sections or components 210,210 are disposed toward or face the oppositely disposed, laterally spaced corner regions of the bulk material cargo container liner 212. Accordingly, when both of the inflatable air bag sections or components 210,210 are inflated, as is illustrated, the bulk cargo material, disposed within the bulk material cargo container liner 212, will be moved toward the oppositely disposed, laterally spaced corner regions of the bulk material cargo container liner 212 so as to be discharged through means of a pair of axially oriented vacuum discharge tube assemblies 230,230 which are located within the oppositely disposed, laterally spaced corner regions of the bulk material cargo container liner 212.

Figure 4:
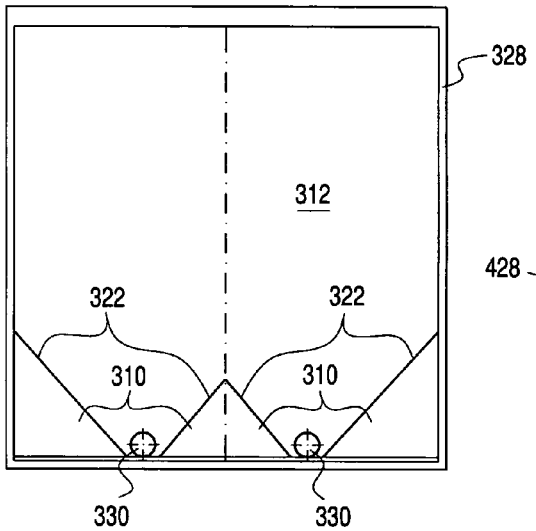
FIG. 4 is a schematic cross-sectional view, similar to those of FIGS. 2 and 3, of a third embodiment of a bulk material cargo container liner disposed within a bulk material cargo container wherein, however, the bulk material cargo container liner has an array of inflatable air bag components, disposed internally within the bulk material cargo container liner, which is effectively a composite or combination of the inflatable air bag components as disclosed within FIGS. 2 and 3 such that the three inflatable air bag components are disposed along the longitudinal centerline region of the bulk material cargo container liner as well as within the laterally spaced oppositely disposed corner regions of the bulk material cargo container liner, and wherein further, a pair of vacuum discharge tube assemblies are interposed between successive ones of the inflatable air bag components, such that when the inflatable air bag components are inflated, as illustrated, the bulk cargo material, disposed within the bulk material cargo container liner, will be moved toward the vacuum discharge tube assemblies so as to be discharged thereby.

In a still yet further similar, but somewhat alternative, manner as illustrated within FIG. 4, which is also to be appreciated as being, in effect, a composite or hybrid arrangement of the arrangements of the inflatable air bag components as has been previously illustrated within FIGS. 2 and 3, it is seen that the substantially right-triangular inflatable air bag components 310 are disposed within both of the oppositely disposed, laterally spaced corner regions of the bulk material cargo container liner 312, disposed internally within the bulk material cargo container 328, as well as being disposed in a substantially back-to-back mode with respect to each other within the axially central region of the bulk material cargo container liner 312. In addition, it is seen that a pair of vacuum discharge tube assemblies 330,330 are disposed within the bulk material cargo container liner 312 such that each one of the vacuum discharge tube assemblies 330,330 is interposed between paired inflatable air bag components 310 respectively disposed within one of the corner regions of the bulk material cargo container liner 312 and one of the inflatable air bag components 310 disposed within the axially central region of the bulk material cargo container liner 312. Accordingly, the hypotenuse portions 322,322 of the paired inflatable air bag components 310,310 are disposed toward or face each other such that when the inflatable air bag components 310 are inflated, as is illustrated, the bulk cargo material, disposed within the bulk material cargo container liner 312, will be moved toward the pair of laterally spaced, axially oriented vacuum discharge tube assemblies 330, 330 so as to be discharged therethrough and out from the bulk material cargo container liner 312.

Figure 5:
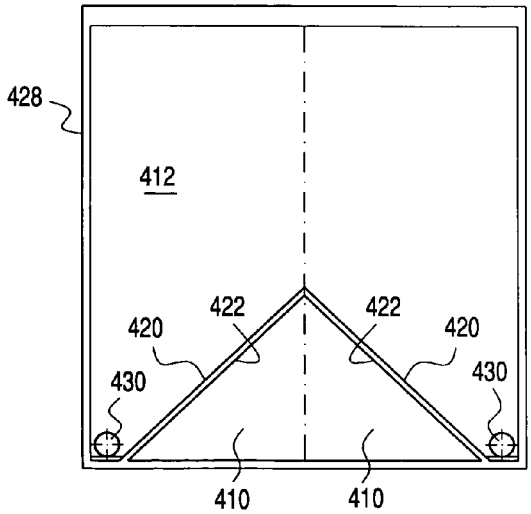
FIG. 5 is a schematic cross-sectional view of a fourth embodiment of a bulk material cargo container liner disposed within a bulk material cargo container wherein a single inflatable air bag component, similar to that as disclosed within

It has been noted or appreciated that, in accordance with the various embodiments illustrated within FIGS. 1-4, the inflatable air bag components have been disposed internally within the corresponding bulk material cargo container liners, however, the inflatable air bag components can likewise be disposed externally of the bulk material cargo container liners. More particularly, for example, as illustrated within FIG. 5, and in a manner similar to the embodiment disclosed within FIG. 3, the vacuum discharge tube assemblies 430,430 are disposed within the oppositely disposed, laterally spaced corner regions of the bulk material cargo container liner 412, however, the inflatable air bag sections or components 410, 410 are disposed externally of the bulk material cargo container liner 412 in such a manner that the hypotenuse portions 422,422 of the inflatable air bag sections or components 410,410 are fixedly secured to undersurface or external surface portions of the bottom wall or floor portion 420 of the bulk material cargo container liner 412. It is to be appreciated that in order to permit or facilitate the movement of the inflatable air bag sections or components 410,410 to their expanded, inflated states from their collapsed, deflated states, and the corresponding movement of the bottom wall or floor portion 420 of the bulk material cargo container liner 412, both the hypotenuse portions 422,422 of the inflatable air bag sections or components 410,410 and the bottom wall or floor portion 420 of the bulk material cargo container liner 412 will comprise, for example, pleated or folded sections.

Figure 6:
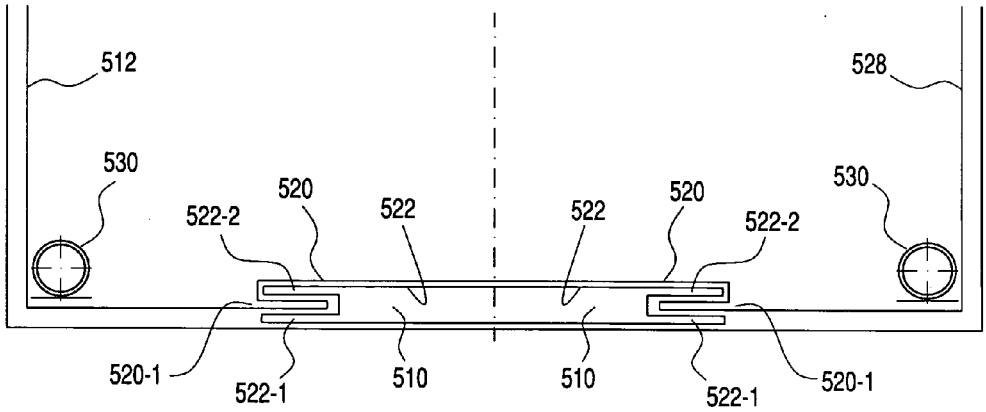
FIG. 6 is a schematic cross-sectional view corresponding to that of FIG. 5 showing, however, one mode in which the inflatable air bag component can be disposed in its collapsed or deflated state or condition.

More particularly, as disclosed within FIG. 6, and in accordance with a first mode of forming the folded or pleated sections within both the hypotenuse portions 522,522 of the inflatable air bag sections or components 510,510 and the bottom wall or floor portion 520 of the bulk material cargo container liner 512, sections of the hypotenuse portions 522, 522 of the inflatable air bag sections or components 510,510 are effectively disposed in an interdigitated manner with respect to sections of the bottom wall or floor portion 520 of the bulk material cargo container liner 512. In particular, it is seen, for example, that sections of the bottom wall or floor portion 520 of the bulk material cargo container liner 512 that are disposed upon opposite sides of the axial centerline of the bulk material cargo container liner 512 define single, inwardly extending sections 520-1, 520-1, whereas sections of the hypotenuse portions 522,522 which are likewise disposed upon opposite sides of the axial centerline of the bulk material cargo container liner 512 define vertically spaced pairs of outwardly extending sections 522-1,522-2. In this manner, the single, inwardly extending sections 520-1 of the bulk material cargo container liner 512 are interposed between the vertically spaced pairs of the outwardly extending sections 522-1,522-2 of the hypotenuse portions 522,522 of the inflatable air bag components 510,510.

Figure 7:
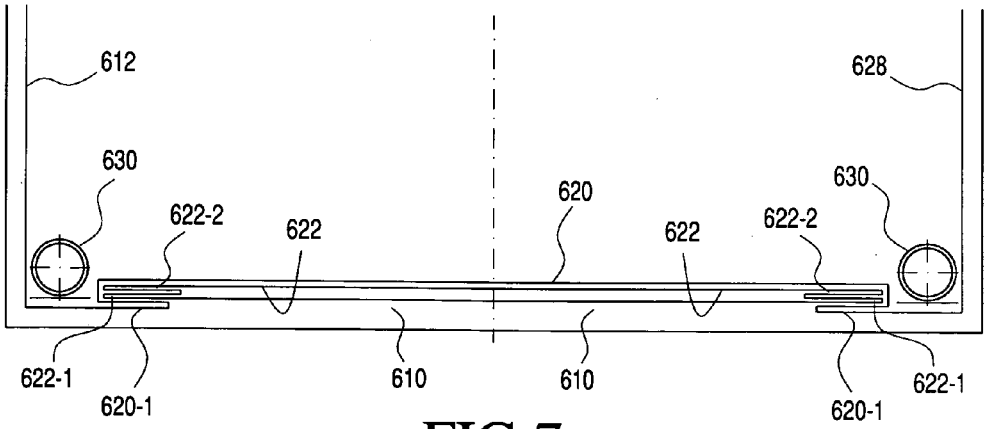
FIG. 7 is a schematic cross-sectional view corresponding to that of FIG. 6 showing, however, another mode in which the inflatable air bag component can be disposed in its collapsed or deflated state or condition.

Alternatively, in accordance with a second mode of forming the folded or pleated sections within both the hypotenuse portions 622,622 of the inflatable air bag sections or components 610,610 and the bottom wall or floor portion 620 of the bulk material cargo container liner 612, as disclosed within FIG. 7, sections of the hypotenuse portions 622,622 of the inflatable air bag sections or components 610,610 are effectively disposed internally within sections of the bottom wall or floor portion 620 of the bulk material cargo container liner 612. More particularly, it is seen, for example, that sections of the bottom wall or floor portion 620 of the bulk material cargo container liner 612 that are disposed upon opposite sides of the axial centerline of the bulk material cargo container liner 612 define single, inwardly extending sections 620-1,620-1, whereas sections of the hypotenuse portions 622,622 which are likewise disposed upon opposite sides of the axial centerline of the bulk material cargo container liner 612 define vertically spaced pairs of outwardly extending sections 622-1,622-2. It is seen still further that the vertically spaced pairs of outwardly extending sections 622-1,622-1 of the hypotenuse portions 622,622 of the inflatable air bag sections or components 610,610 are effectively interposed between the single, oppositely disposed, inwardly extending sections 620-1,620-1 of the bottom wall or floor portion 620 of the bulk material cargo container liner 612 and the primary central region of the bottom wall or floor portion 620 of the bulk material cargo container liner 612. Accordingly, as is the case with the embodiment disclosed within FIG. 6, when the inflatable air bag components 510,510,610,610 are inflated and therefore expanded, the inflatable air bag components 510, 510,610,610 can attain their inflated states similar to those as illustrated within FIG. 5 with respect to the inflatable air bag components 410,410.

Figure 8:
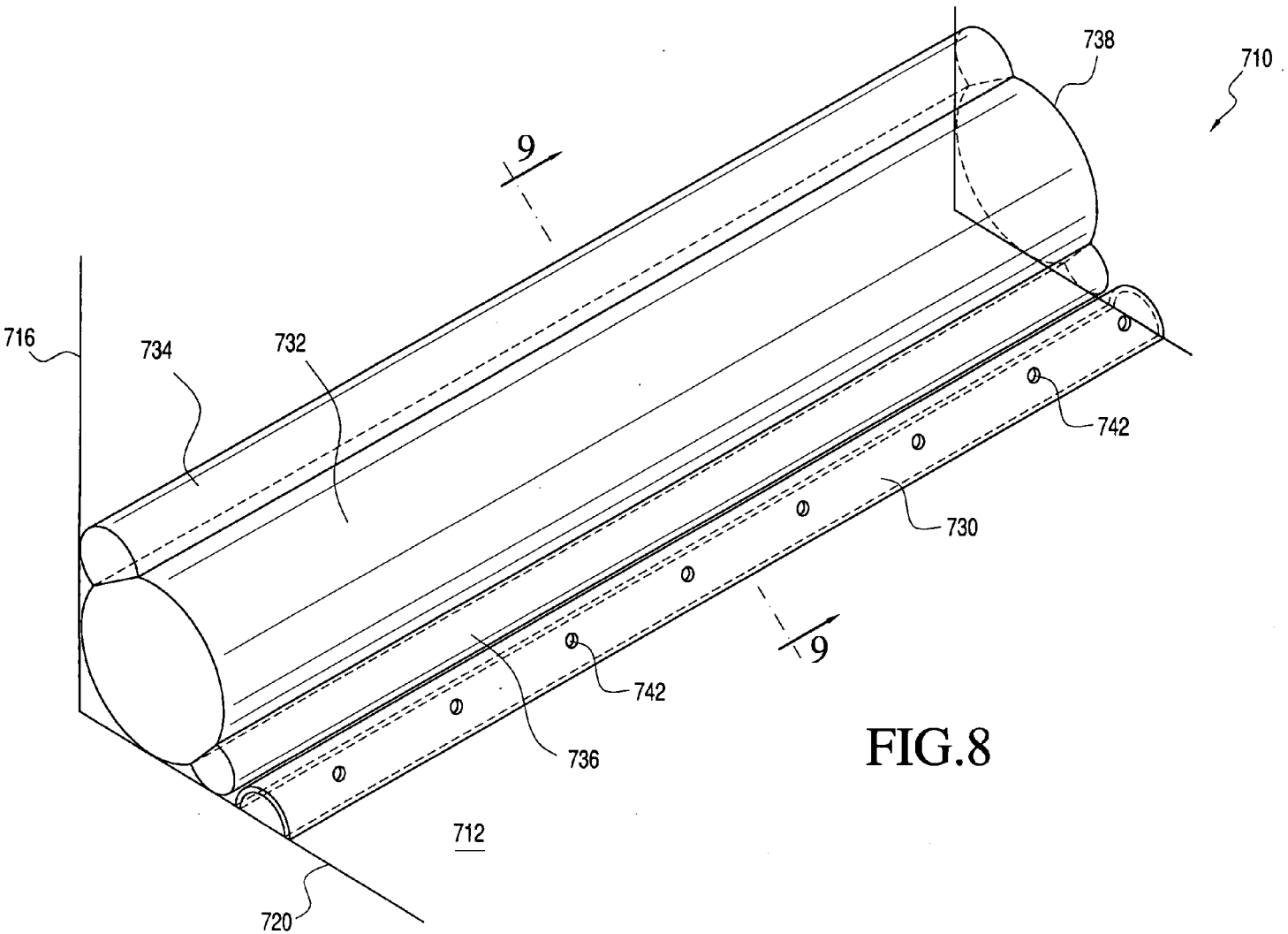
FIG. 8 is a partial perspective view of a fifth embodiment of a bulk material cargo container liner, for use within a bulk material cargo container, wherein the bulk material cargo container liner has a pair of inflatable air bag components, each one of which comprises a plurality of compartments which together define a substantially triangular cross-sectional configuration and is disposed internally within each one of the oppositely disposed, laterally spaced corner regions of the bulk material cargo container liner such that when the inflatable air bag components are inflated, as illustrated, the bulk cargo material, disposed within the bulk material cargo container liner, will be moved toward the longitudinal centerline region of the bulk material cargo container liner so as to be discharged through means of a single vacuum discharge tube assembly, having a half-round cross-sectional configuration, located along the longitudinal centerline region of the bulk material cargo container liner.

In connection with the various embodiments of the new and improved inflatable air bag components, as have been illustrated within FIGS. 1-5, that while all of the inflatable air bag components have been noted as comprising truly right-triangular cross-sectional configurations, inflatable air bag components having cross-sectional configurations which are not necessarily right-triangular but which nevertheless have broadly or substantially right-triangular cross-sectional configurations are likewise able to be utilized in conjunction with the bulk material cargo container liners. For example, as illustrated within FIGS. 8 and 9, a further embodiment of a new and improved inflatable air bag component, which has also been constructed in accordance with the principles and teachings of the present invention, and which is likewise adapted to be utilized within a corner region of a new and improved bulk material cargo container liner assembly which has also been constructed in accordance with the principles and teachings of the present invention, so as to facilitate the discharge or unloading of bulk cargo materials from the bulk material cargo container liner and the bulk material cargo container without necessitating any operative tilting of the bulk material cargo container, is disclosed and is generally indicated by the reference character 710.

More particularly, it is seen that the new and improved inflatable air bag component 710 has a substantially right-triangular configuration so as to effectively permit or facilitate the inflatable air bag component 710 to be disposed within an internal corner region of a bulk material cargo container liner 712 which has the configuration of a rectangular parallelepiped, as is conventionally known, however, in lieu of the true right-triangular cross-sectional configuration characteristic of the inflatable air bag component 10 as illustrated within FIG. 1 wherein the vertically oriented leg portion 14 of the inflatable air bag component 10 was adapted to be disposed along the vertical side wall 16 of the bulk material cargo container liner 12 while the horizontally oriented leg portion 18 of the inflatable air bag component 10 was adapted to be disposed along the bottom wall or floor portion 20 of the bulk material cargo container liner 12, the inflatable air bag component 710 comprises a primary or main inflatable air bag section or compartment 732, and a pair of secondary or auxiliary inflatable air bag sections or compartments 734, 736. The primary or main inflatable air bag section or compartment 732 has a substantially circular cross-sectional configuration, while each one of the secondary or auxiliary inflatable air bag sections or compartments 734,736 has a substantially semi-circular or truncated circular cross-sectional configuration, and it is to be appreciated that suitable portions of the primary or main inflatable air bag section or compartment 732, as well as suitable portions of each one of the secondary or auxiliary inflatable air bag sections or compartments 734,736, are connected to internal regions of the vertical side wall 716 of the bulk material cargo container liner 712 and the bottom wall or floor portion 720 of the bulk material cargo container liner 712. It is noted further that the secondary or auxiliary inflatable air bag sections or compartments 734,736 may have substantially the same diametrical extents or, as illustrated, the upper inflatable air bag section or compartment 734 may be larger in its diametrical extent than that of the lower inflatable air bag section or compartment 736.

Still further, the secondary or auxiliary inflatable air bag sections or compartments 734,736 may be integrally connected to the primary or main inflatable air bag section or compartment 732 so as to be disposed diametrically opposite each other, or alternatively, the inflatable air bag sections or compartments 734,736 may be angularly offset with respect to a common diameter of the primary or main inflatable air bag section or compartment 732. These variations in size and position of the secondary or auxiliary inflatable air bag sections or compartments 734,736 with respect to the primary or main inflatable air bag section or compartment 732 will serve to vary the relative disposition of the primary or main inflatable air bag section or compartment 732 with respect to the vertical side wall 716 and the bottom or floor portion 720 of the bulk material cargo container liner 712. Accordingly, the disposition and angular orientation of the primary or main inflatable air bag section or compartment 732, and particularly the disposition and angular orientation of the arcuate surface portion 738 of the primary or main inflatable air bag section or compartment 732, which corresponds to the hypotenuse portions 22,122,222,322 of the embodiments illustrated within FIGS. 1-4 and which faces or is disposed toward the internal axial region of the bulk material cargo container liner 712, is varied so as to optimize the angular disposition of the arcuate surface portion 738 of the primary or main inflatable air bag section or compartment 732 in order to positively affect the movement of the bulk cargo material toward the vacuum discharge tube assembly 730.

It is noted further that the provision of the two secondary or auxiliary inflatable air bag sections or compartments 734,736 upon the primary or main inflatable air bag section or compartment 732 tend to stabilize and retain the disposition of the primary or main inflatable air bag section or compartment 732 with respect to the internal corner region of the bulk material cargo container liner 712 in view of the fact that the two secondary or auxiliary inflatable air bag sections or compartments 734,736 respectively engage or are seated upon the vertical side wall 716 and the bottom or floor portion 720 of the bulk material cargo container liner 712 when the inflatable air bag assembly 710 is inflated. In addition, the provision of the two secondary or auxiliary inflatable air bag sections or compartments 734,736 upon the primary or main inflatable air bag section or compartment 732 also effectively serve to prevent any substantial amount of the bulk cargo material, disposed within the bulk material cargo container liner, from becoming trapped either between the primary or main inflatable air bag section or compartment 732 and the vertical side wall 716 of the bulk material cargo container liner 712, or between the primary or main inflatable air bag section or compartment 732 and the bottom or floor region 720 of the bulk material cargo container liner 712.

Still yet further, it is noted that, in lieu of the vacuum discharge tube assembly 730 having a substantially circular cross-sectional configuration, as was the case with the various vacuum discharge tube assemblies 130-630 as disclosed within FIGS. 1-7, the vacuum discharge tube assembly 730 comprises, in effect, a half-round structure that has a substantially semi-circular cross-sectional configuration. This structure has several operational advantages, such as, for example, the fact that it is inherently stable with respect to its positional disposition within the bottom region of the bulk material cargo container liner 712, and in addition, such structure effectively serves to prevent any substantial amount of the bulk cargo material, disposed within the bulk material cargo container liner 712, from becoming trapped between side portions of the vacuum discharge tube assembly 730 and the bottom or floor region 720 of the bulk material cargo container liner 712. As may be readily appreciated further from FIGS. 8 and 9, in accordance with the particular structure characteristic of the vacuum discharge tube assembly 730, the vacuum discharge tube assembly 730 has two sets of axially spaced apertures 740,742 defined within the upper peripheral regions thereof.

Figure 9:
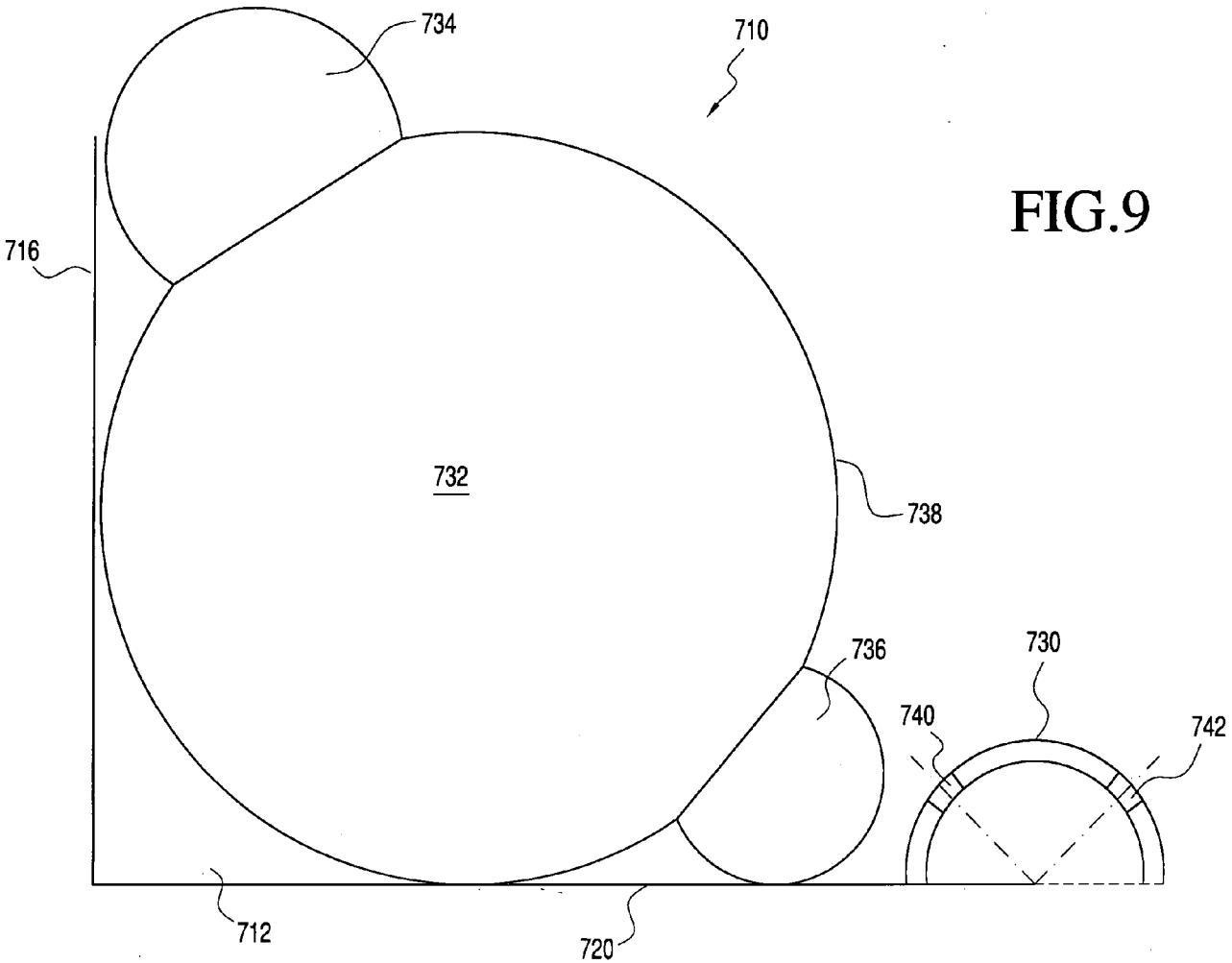
FIG. 9 is an enlarged cross-sectional view of the fifth embodiment of the bulk material cargo container liner as illustrated within FIG. 8 and as taken along the lines 9-9 of FIG. 8.
Figure 10:
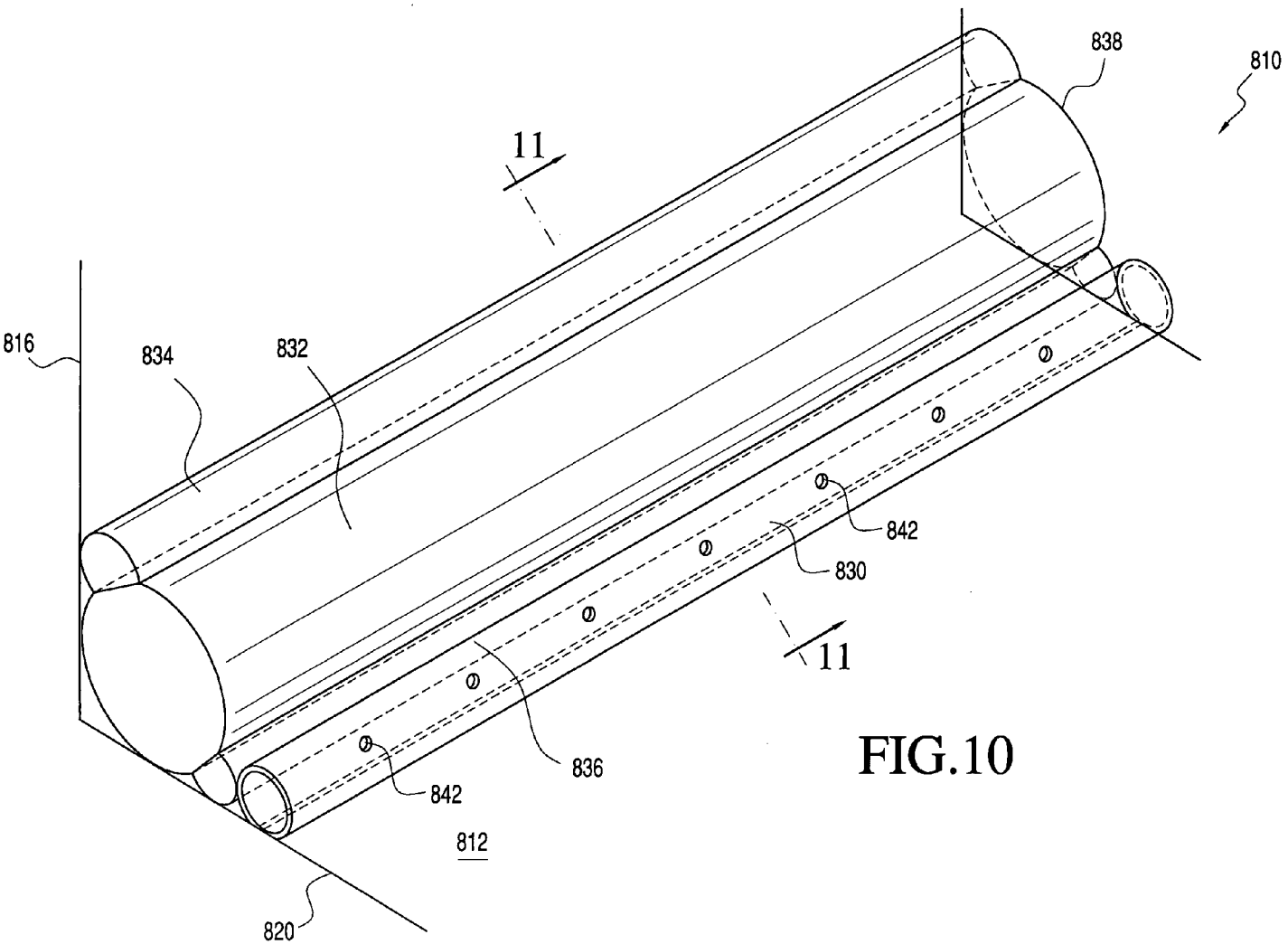
FIG. 10 is a partial perspective view, similar to that of FIG. 8, showing, however, a sixth embodiment of a bulk material cargo container liner, for use within a bulk material cargo container, wherein the bulk material cargo container liner has a pair of inflatable air bag components disposed internally within each one of the oppositely disposed, laterally spaced corner regions of the bulk material cargo container liner and a single vacuum discharge tube assembly, having a full-round cross-sectional configuration, located along the longitudinal centerline region of the bulk material cargo container liner.
Figure 11:
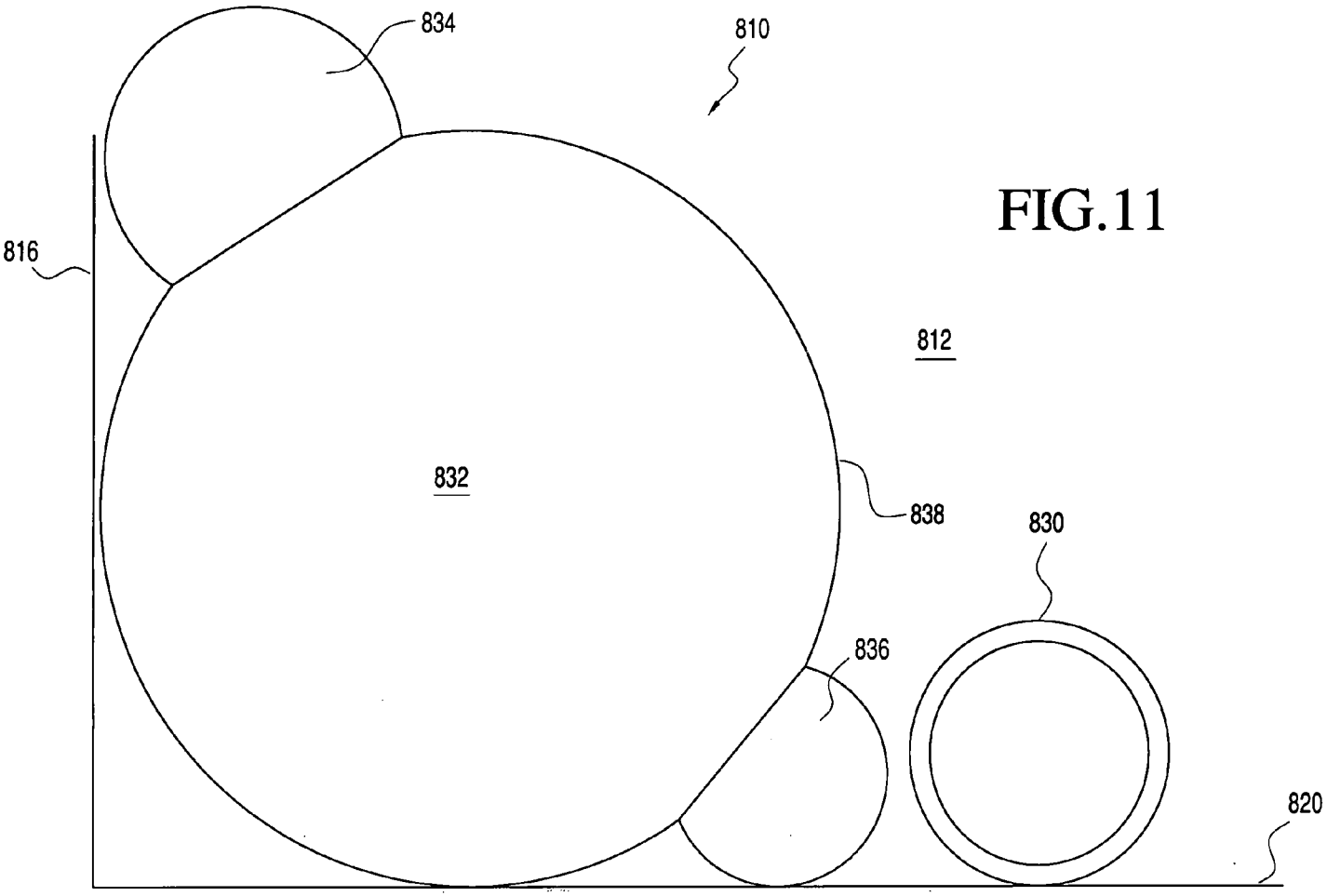
FIG. 11 is an enlarged cross-sectional view of the sixth embodiment of the bulk material cargo container liner as illustrated within FIG. 10 and as taken along the lines 11-11 of FIG. 10.

It is particularly noted, as may best be appreciated from FIG. 9, that the apertures 740,742 are angularly separated from each other through means of a predetermined angular or arcuate separation, such as, for example, approximately 90°, and in this manner, the apertures 740,742 will be respectively disposed at proper angular orientations with respect to the angle of repose or flowability angle of the bulk cargo material disposed within the bulk material cargo container liner 712. Accordingly, when the vacuum discharge tube assembly 730 is utilized within any bulk material cargo container liner system similar to, for example, any one of the bulk material cargo container liner systems as illustrated within FIGS. 2-5, the bulk cargo material, disposed within the bulk material cargo container liner 712, may be readily evacuated, exhausted, or discharged from the interior region of the bulk material cargo container liner 712. Alternatively, of course, a vacuum discharge tube assembly, which in fact has a full-round or substantially circular cross-sectional configuration, as has been previously noted in conjunction with the various inflatable air bag components 110-610 as illustrated within FIGS. 2-7, can of course be utilized in conjunction with an inflatable air bag component which is similar to the inflatable air bag component 710 as illustrated within FIGS. 8 and 9. Accordingly, such a system is illustrated within FIGS. 10 and 11, it being noted that the various structural components or members of the inflatable air bag and vacuum discharge tube system as illustrated within FIGS. 10 and 11 have been denoted by reference characters which are similar to those utilized in connection with the corresponding structural components illustrated within the system of FIGS. 8 and 9 except that the reference characters are within the 800 series.

Figure 12:
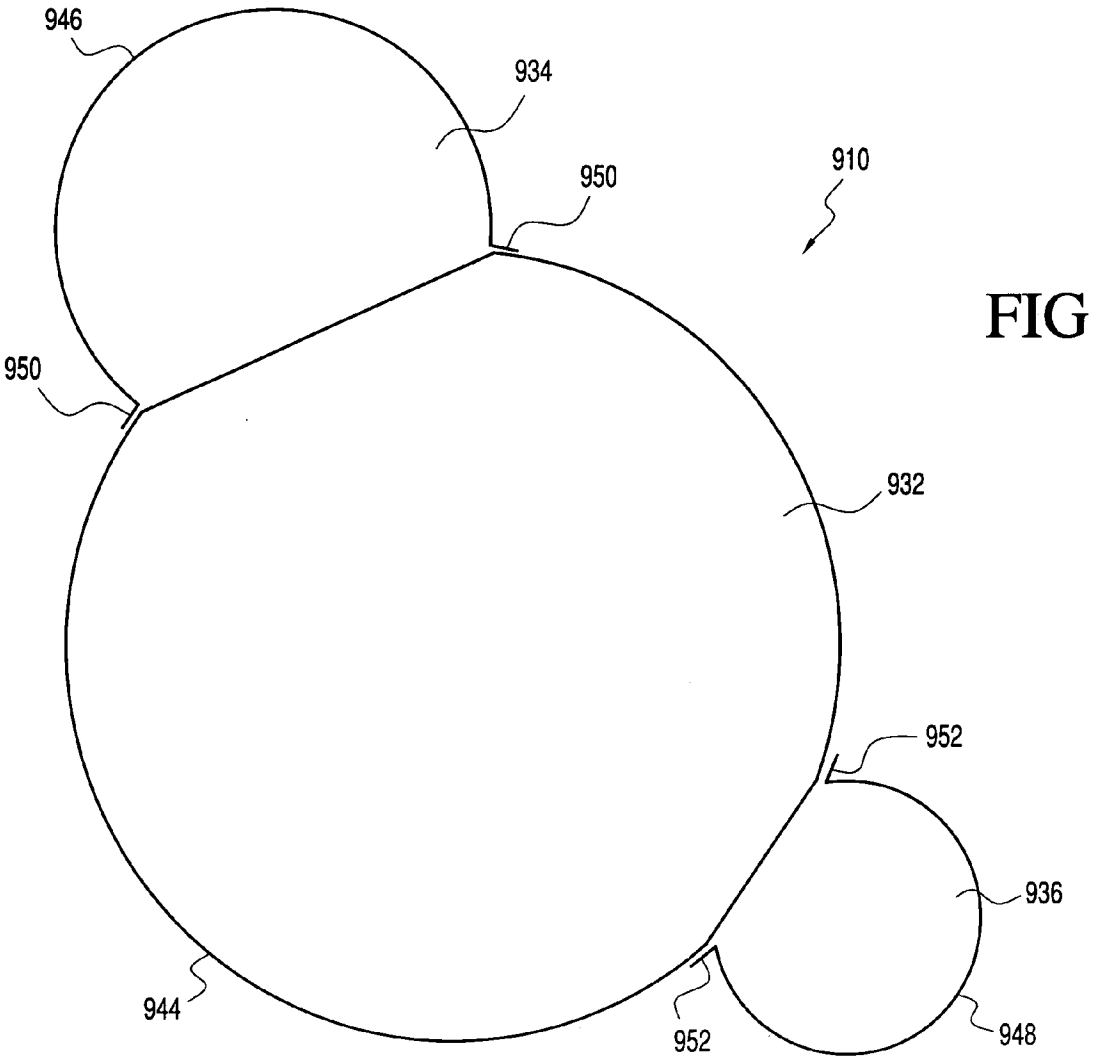
FIG. 12 is an enlarged cross-sectional view of an inflatable air bag component, similar to either one of the inflatable air bag components as illustrated within FIG. 9 or 11, disclosing a first mode of forming and integrally connecting together the three inflatable compartments comprising the inflatable air bag component.
Figure 13A:
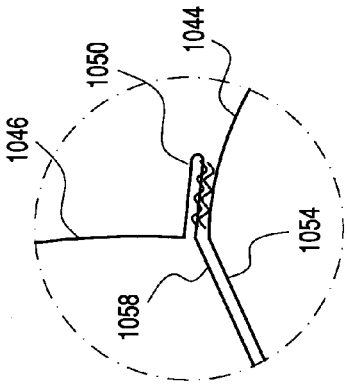
FIG. 13A is an enlarged view of the circled region shown within FIG. 13 showing the details of the integral connection of one of the small inflatable compartments to the primary large inflatable compartment.
Figure 13:
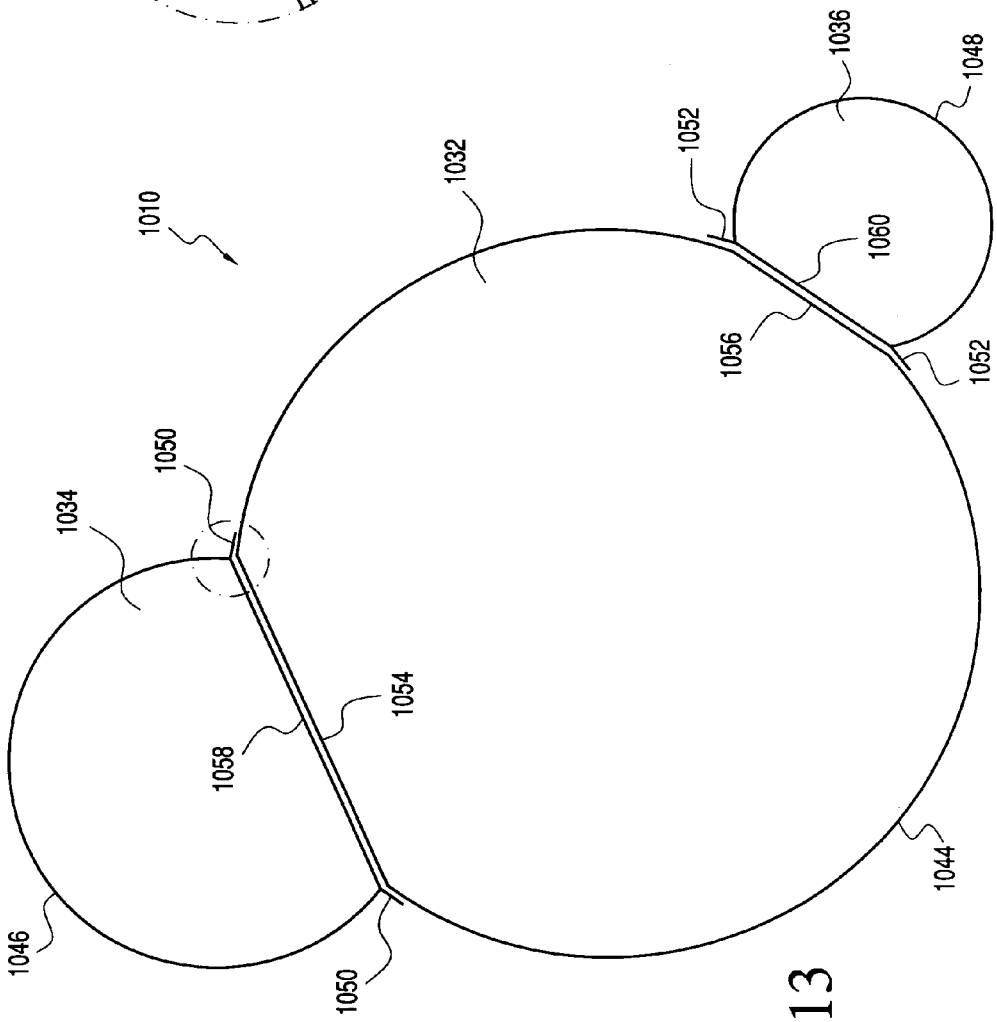
FIG. 13 is an enlarged cross-sectional view, similar to that of FIG. 12, illustrating, however, a second mode of forming and integrally connecting together the three inflatable compartments of the inflatable air bag component.
Figure 14:
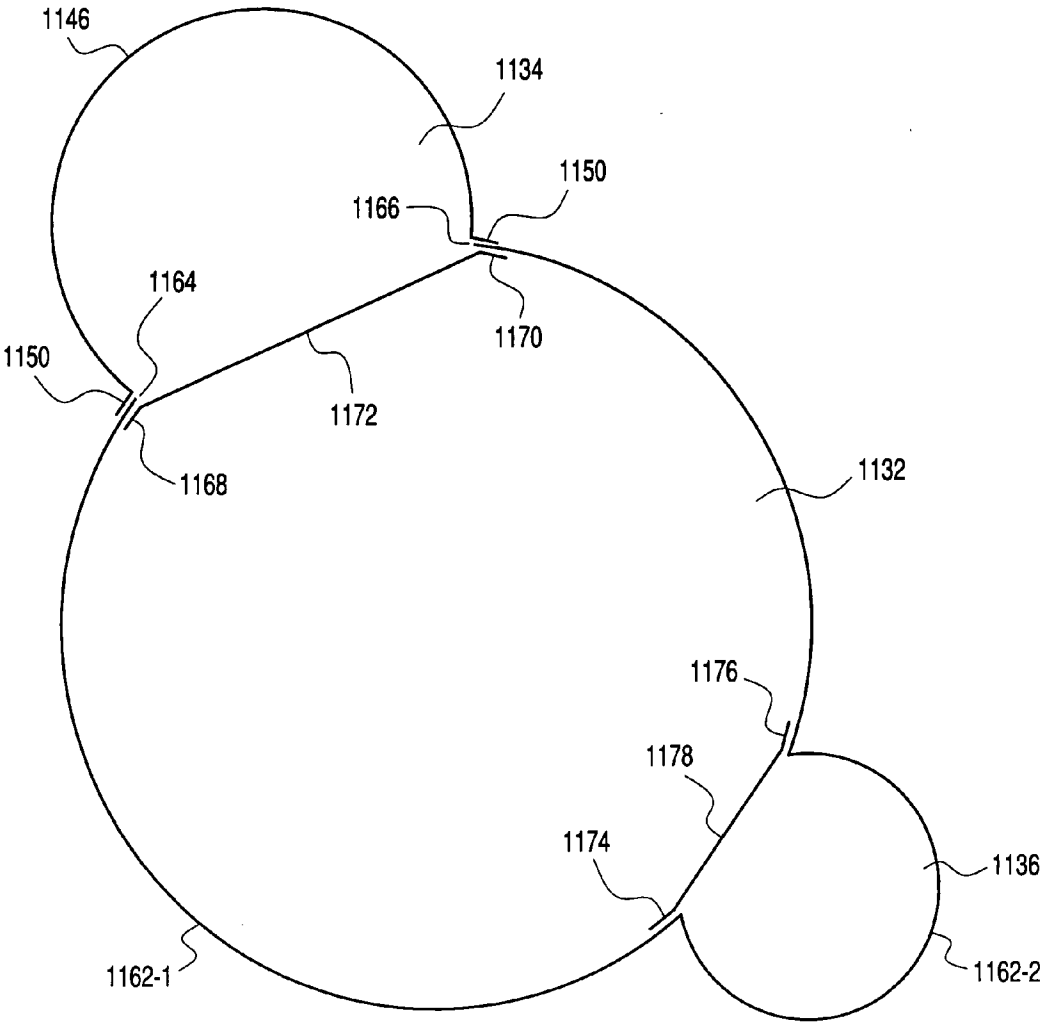
FIG. 14 is an enlarged cross-sectional view, similar to those of FIGS. 12 and 13, illustrating, however, a third mode of forming and integrally connecting together the three inflatable compartments of the inflatable air bag component.

With reference now being made to FIGS. 12-14, several different techniques of fabricating the multiple-section, or multiple-compartment, inflatable air bag components, similar to those illustrated at 710,810 within FIGS. 8-11, will be described. More particularly, as disclosed within FIG. 12, in accordance with a first technique of fabricating a multiple-section, or multiple-compartment, inflatable air bag component, which is generally indicated by the reference character 910 and which comprises a primary or main inflatable air bag section or compartment 932, and a pair of secondary or auxiliary inflatable air bag sections or compartments 934,936, is to fabricate the primary or main inflatable air bag section or compartment 932 as a tubular member or balloon 944 so as to effectively define the enclosed inflatable section or compartment. Suitable inflation means, not shown, is of course fluidically mounted upon the tubular member or balloon 944 so as to permit inflation of the same in conjunction with the discharge of the bulk cargo material from the bulk material cargo container liner within which the inflatable air bag component 910 is disposed. To the contrary, it is seen that each one of the secondary or auxiliary inflatable air bag sections or compartments 934, 936 is respectively fabricated from a web member 946,948, each one of which is respectively provided with a pair of oppositely disposed flap members 950,952 which are adapted to be sealed to external peripheral surface portions of the tubular member or balloon 944 by any suitable means, such as, for example, heat sealing means, adhesive means, adhesive tape means, or the like. Accordingly, when the web members 946,948 are formed, mounted, and sealed upon the external peripheral surface portions of the tubular member or balloon 944, the secondary or auxiliary inflatable air bag sections or compartments 934,936 will be formed, whereby, in turn, the composite multiple-section, or multiple-compartment, inflatable air bag component 910 will be formed. Of course, it is to be understood further that suitable inflation means, also not shown, are provided in conjunction with each one of the secondary or auxiliary inflatable air bag sections or compartments 934,936 so as to permit the inflation of the same in conjunction with the inflation of the primary or main inflatable air bag section or compartment 932 of the inflatable air bag component 910.

Continuing further, as disclosed within FIG. 13, and in accordance with a second technique of fabricating a multiple-section, or multiple-compartment, inflatable air bag component, which is generally indicated by the reference character 1010 and which comprises a primary or main inflatable air bag section or compartment 1032 and a pair of secondary or auxiliary inflatable air bag sections or compartments 1034, 1036, all three of the inflatable air bag sections or compartments, comprising the primary or main inflatable air bag section or compartment 1032 and the pair of secondary or auxiliary inflatable air bag sections or compartments 1034, 1036, being fabricated as tubular members or balloons 1044, 1046,1048 so as to effectively define or form the respective enclosed inflatable sections or compartments 1032,1034,1036. Suitable inflation means, not shown, are of course fluidically mounted upon the tubular members or balloons 1044,1046,1048 so as to permit inflation of the same in conjunction with the discharge of the bulk cargo material from the bulk material cargo container liner within which the inflatable air bag component 1010 is disposed.

In order to actually mount each one of the secondary or auxiliary inflatable air bag sections or compartments 1034, 1036 upon the primary or main tubular member or balloon 1044, external peripheral surface regions 1054,1056 of the primary or main tubular member or balloon 1044 are substantially flattened or planar, and each one of the tubular members or balloons 1046,1048 comprising the inflatable sections or compartments 1034,1036 is seen to have a corresponding flattened or planar section 1058,1060 which is respectively adapted to be seated upon a corresponding one of the flattened or planar regions 1054,1056 of the primary or main tubular member or balloon 1044. In addition, each one of the tubular members or balloons 1046,1048 is provided with a pair of oppositely disposed flap members 1050,1052 which are disposed upon opposite sides of the flattened or planar regions 1058,1060 and which are adapted to be sealed to external peripheral surface portions of the tubular member or balloon 1044, which are disposed adjacent to the flattened or planar regions 1054,1056, by any suitable means, such as, for example, heat sealing means, adhesive means, adhesive tape means, or the like, as is more particularly disclosed in detail within FIG. 13A. Accordingly, when the web members 1046, 1048 are formed, mounted, and sealed upon the external peripheral surface portions 1054, 1056 of the primary or main tubular member or balloon 1044, the composite multiple-section, or multiple-compartment, inflatable air bag component 1010 will be formed.

Lastly, in connection with the fabrication of the multiple-section, or multiple-compartment, inflatable air bag component as disclosed within FIG. 14, and particularly in accordance with a third technique of fabricating a multiple-section, or multiple-compartment, inflatable air bag component, which is generally indicated by the reference character 1110 and which comprises a primary or main inflatable air bag section or compartment 1132 and a pair of secondary or auxiliary inflatable air bag sections or compartments 1134, 1136, it is seen that the primary or main inflatable air bag section or compartment 1132 and the second one of the pair of secondary or auxiliary inflatable air bag sections or compartments 1136 are fabricated from a single web member which structurally comprises integrally connected web member sections 1162-1,1162-2 so as to effectively form the substantially tubular members which define the primary or main inflatable air bag section or compartment 1132 and the second one of the pair of secondary or auxiliary inflatable air bag sections or compartments 1136. It is additionally noted, however, that the ends of the web member section 1162-1, which define the arcuate region of the primary or main inflatable air bag section or compartment 1132 at which the first one of the pair of secondary or auxiliary inflatable air bag sections or compartments 1134 is mounted or connected, are open as at 1164, 1166. In addition, it is also noted that the first one of the pair of secondary or auxiliary inflatable air bag sections or compartments 1134 is also fabricated from a web member 1146, and in order to effectively close the interface defined between the open ends 1164,1166 of the web member section 1162-1 which defines the primary or main inflatable air bag section or compartment 1132, and the web member 1146 which defines or forms the first one of the pair of secondary or auxiliary inflatable air bag sections or compartments 1134, oppositely disposed flap members 1168,1170 of a first gusset member 1172 are fixedly sealed upon internal surface portions of the open ends 1164,1166 of the web member section 1162-1. In a similar manner, oppositely disposed flap members 1150, 1150 are fixedly sealed upon external surface portions of the open ends 1164,116 of the web member section 1162-1 so as to effectively define a three-layer laminate seal region. Still further, it is also seen that in order to effectively close the interface effectively located at the junction defining the primary or main inflatable air bag section or compartment 1132 and the second one of the pair of secondary or auxiliary inflatable air bag sections or compartments 1136, oppositely disposed flap members 1174, 1176 of a second gusset member 1178 are fixedly sealed upon those internal surface portions of the web member section 1162-1 which are located at the junction defining the primary or main inflatable air bag section or compartment 1132 and the second one of the pair of secondary or auxiliary inflatable air bag sections or compartments 1136.

Figure 15:
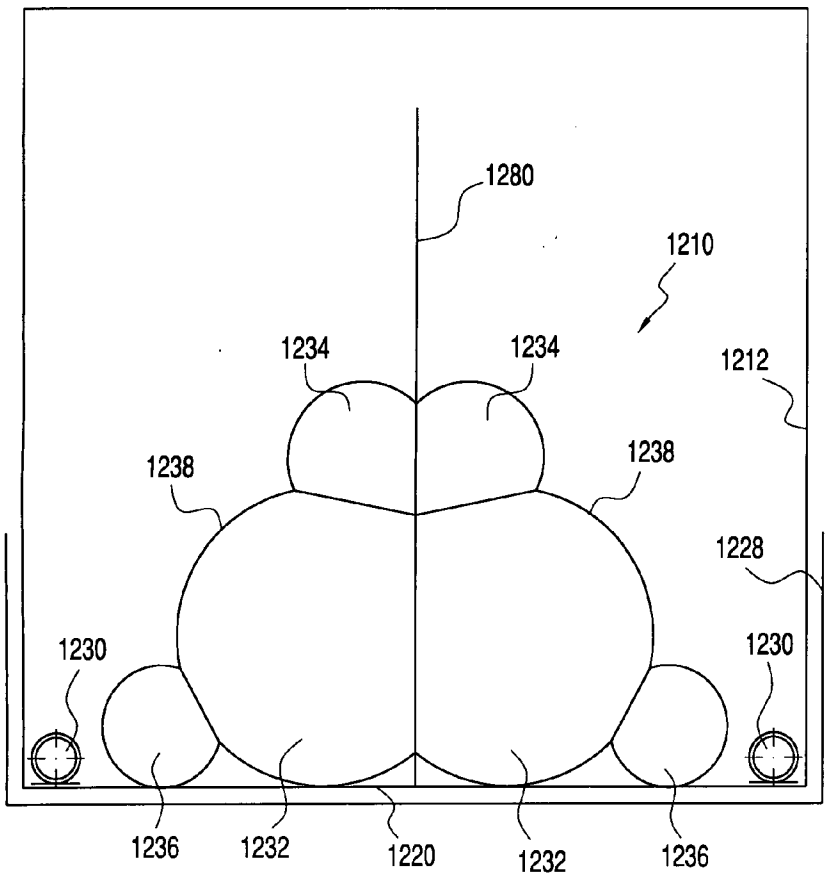
FIG. 15 is a schematic cross-sectional view, similar to that of FIG. 3, showing, however, a seventh embodiment of a bulk material cargo container liner disposed within a bulk material cargo container wherein, in lieu of the substantially isosceles triangular configuration of the inflatable air bag component disposed within the bulk material cargo container liner as disclosed within FIG. 3, the bulk material cargo container liner has a pair of inflatable air bag components disposed internally within the bulk material cargo container liner so as to be disposed in a back-to-back mode along the longitudinal centerline region of the bulk material cargo container liner, and wherein further, each one of the inflatable air bag components comprises a structural arrangement which is similar to the inflatable air bag components, as disclosed within any one of the FIGS. 8-14, so as to comprise the plurality of inflatable compartments which together define a substantially triangular cross-sectional configuration when disposed in their inflated states as illustrated.

With reference now being made to FIG. 15, a seventh embodiment of a bulk material cargo container liner and inflatable air bag component system which, in turn, is disposed within a bulk material cargo container, is disclosed. The bulk material cargo container liner and inflatable air bag component system as disclosed within FIG. 15 is seen to be similar to that disclosed within FIG. 3 in that a pair of inflatable air bag components 1210,1210 are disposed internally within the bulk material cargo container liner 1212 at the central axial region of the bulk material cargo container liner 1212, and a pair of vacuum discharge tube assemblies 1230 are disposed within the oppositely disposed corner regions of the bulk material cargo container liner 1212, however, in lieu of the substantially isosceles triangular configuration of the inflatable air bag components 210,210 disposed within the bulk material cargo container liner 212 as disclosed within FIG. 3, the bulk material cargo container liner 1212 has the pair of inflatable air bag components 1210,1210, which are substantially similar to the inflatable air bag components as disclosed in FIGS. 8-14, disposed in a back-to-back mode along the longitudinal centerline region of the bulk material cargo container liner 1212.

Accordingly, it is appreciated that each one of the inflatable air bag components 1210,1210 comprises a structural arrangement fabricated from the plurality of inflatable compartments 1232,1234,1236 which together define a substantially triangular cross-sectional configuration when disposed in their inflated states, as is illustrated, so as to effectively define the outer hypotenuse regions 1238,1238 for effectively moving the bulk cargo material toward the vacuum discharge tube assemblies 1230,1230 in order to in fact exhaust or discharge the bulk cargo material from the interior portion of the bulk material cargo container liner 1212 after the angle of repose of the bulk cargo material has reached that point at which the bulk cargo material will no longer naturally flow toward the exhaust discharge port. More particularly, it is seen that those regions of the primary or main inflatable air bag sections or compartments 1232,1232 which are effectively connected to each other in the aforenoted back-to-back mode are actually somewhat truncated, and it is noted further that an axially extending, vertically oriented gusset member 1280 is located along the longitudinal centerline of the bulk material cargo container liner 1212 so as to extend, in effect, from the front wall member thereof to the rear wall member thereof.

Figure 16:
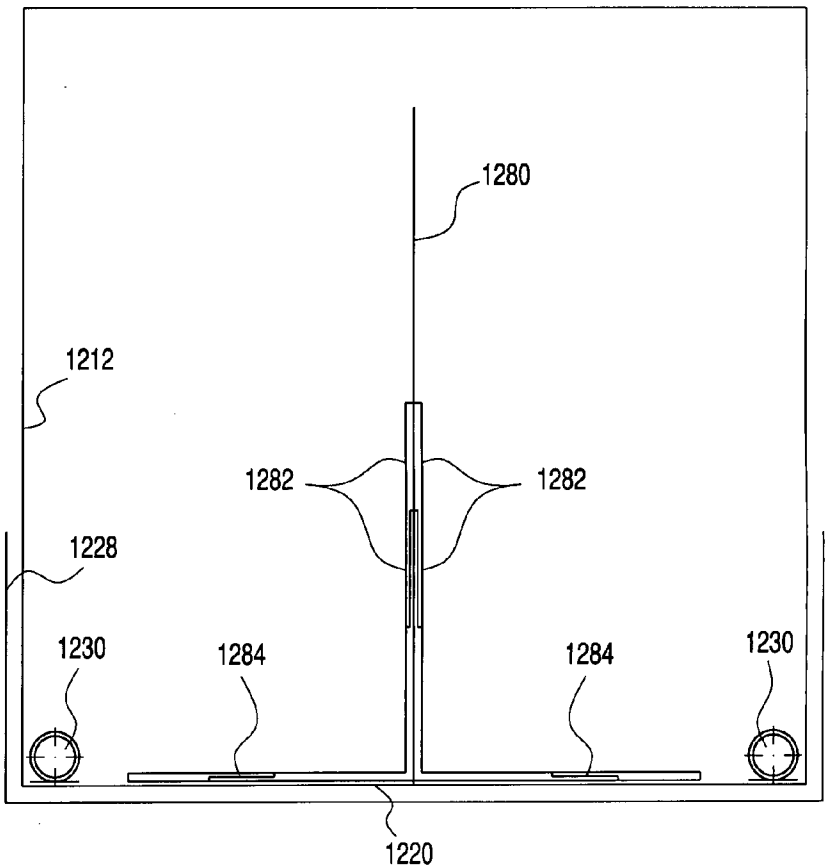
FIG. 16 is a schematic cross-sectional view, corresponding to that of FIG. 15, showing, however, the inflatable air bag components in their deflated states.

It is additionally seen that predetermined regions 1282, 1282 of each one of the truncated portions of the primary or main inflatable air bag sections or compartments 1232,1232 of the inflatable air bag components 1210,1210, as well as predetermined regions 1284,1284 of each one of the main or primary inflatable air bag sections or compartments 1232, 1232 of the inflatable air bag components 1210,1210 which are disposed adjacent to the bottom or floor region 1220 of the bulk material cargo container liner 1212, are folded and fixedly secured to the gusset member 1280 as well as to the floor or bottom region 1220 of the bulk material cargo container liner 1212. In this manner, the proper dispositions or locations of the inflatable air bag components 1210,1210 within the bulk material cargo container liner 1212 are effectively maintained when the inflatable air bag components 1210,1210 are disposed in their deflated states as illustrated within FIG. 16 so as to permit the proper inflation and disposition of the same internally within the bulk material cargo container liner 1212 when the inflatable air bag components 1210,1210 are inflated to their deployed states for use in discharging or exhausting the bulk cargo material from the interior of the bulk material cargo container liner 1212.

With reference now being made to FIGS. 17-21, additional embodiments of bulk material cargo container liner and inflatable air bag component systems, for use within bulk material cargo containers, are disclosed. With reference being initially made, for example, to FIG. 17, an eighth embodiment of a bulk material cargo container liner and an inflatable air bag component system is disclosed and is seen to be similar to that disclosed within FIG. 4 in that three inflatable air bag components 1310,1310,1310 are disposed internally within the bulk material cargo container liner 1312 at the corner and central axial regions of the bulk material cargo container liner 1312, and a pair of vacuum discharge tube assemblies 1330, 1330 are interposed between the three inflatable air bag components 1310,1310, 1310, however, in lieu of the substantially isosceles triangular configuration of the inflatable air bag components 310 disposed within the bulk material cargo container liner 312 as disclosed within FIG. 4, each one of the inflatable air bag components 1310,1310,1310 as disposed within the bulk material cargo container liner 1312 are substantially similar to the inflatable air bag components as disclosed within FIGS. 8-15. More particularly, it is appreciated that each one of the inflatable air bag components 1310, 1310,1310 comprises a structural arrangement fabricated from the plurality of inflatable compartments 1332,1334,1336 which together define a substantially triangular cross-sectional configuration when disposed in their inflated states, as is illustrated, so as to effectively define the outer hypotenuse regions 1338,1338,1338 for effectively moving the bulk cargo material toward the vacuum discharge tube assemblies 1330,1330 in order to in fact exhaust or discharge the bulk cargo material from the interior portion of the bulk material cargo container liner 1312 after the angle of repose of the bulk cargo material has reached that point at which the bulk cargo material will no longer naturally flow toward the exhaust discharge port.

More particularly, still further, it is seen that two of the three inflatable air bag components 1310, 1310 are disposed within the oppositely disposed corner regions of the bulk material cargo container liner 1312 in a manner similar to that disclosed in connection with the inflatable air bag components as illustrated within FIGS. 8-11, however, it is seen that the third one of the three inflatable air bag components 1310 has in effect been rotated 900 from its normal disposition such that in lieu those regions of the primary or main inflatable air bag sections or compartments 1332,1332 being fixedly secured to the vertical side walls or bottom floor member of the bulk material cargo container liner 1312, the inflatable air bag component 1310 is effectively secured, in effect, only along its hypotenuse portion 1338 while additional hypotenuse portions 1322,1322 are effectively defined along the right-angled leg portions thereof. It is lastly noted that in order to protect each one of the inflatable air bag component compartments 1332, 1334,1336 from particular bulk cargo materials, such as, for example, pellets or the like, particularly under inflation conditions, each one of the inflatable air bag components 1310,1310,1310 can be provided with a suitable additional layer or laminate member 1386, each one of which is disposed along the aforenoted hypotenuse portion 1322, 1322,1338,1338 of a respective one of the inflatable air bag components 1310,1310,1310 and is effectively interconnected between each one of the inflatable air bag components 1310,1310, 1310 and a respective one of the vacuum discharge tube assemblies 1330,1330.

Figure 17:
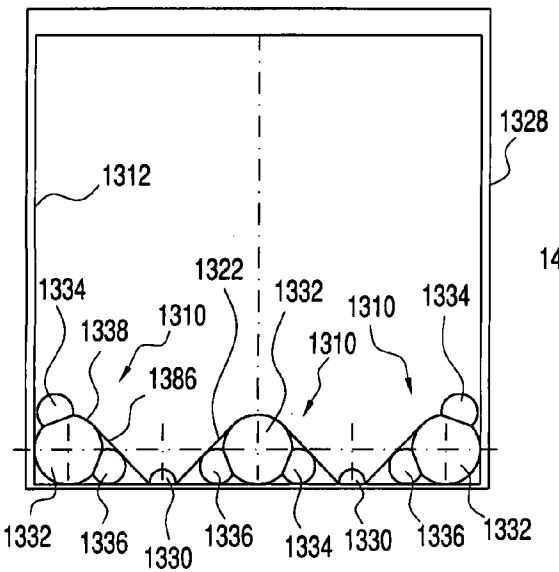
FIG. 17 is a schematic cross-sectional view, similar to that of FIG. 4, showing, however, an eighth embodiment of a bulk material cargo container liner disposed within a bulk material cargo container wherein, in lieu of the substantially right triangular and isosceles triangular configurations of the inflatable air bag components disposed within the bulk material cargo container liner as disclosed within FIG. 4, the bulk material cargo container liner has a plurality of inflatable air bag components disposed internally within the bulk material cargo container liner, within the laterally spaced corner regions of the bulk material cargo container liner as well as along the longitudinal centerline region of the bulk material cargo container liner, and wherein further, each one of the inflatable air bag components comprises a structural arrangement which is similar to the inflatable air bag components, as disclosed within any one of the FIGS. 8-14, so as to comprise the plurality of inflatable compartments which together define a substantially triangular cross-sectional configuration when disposed in their inflated states as illustrated.
Figure 18:
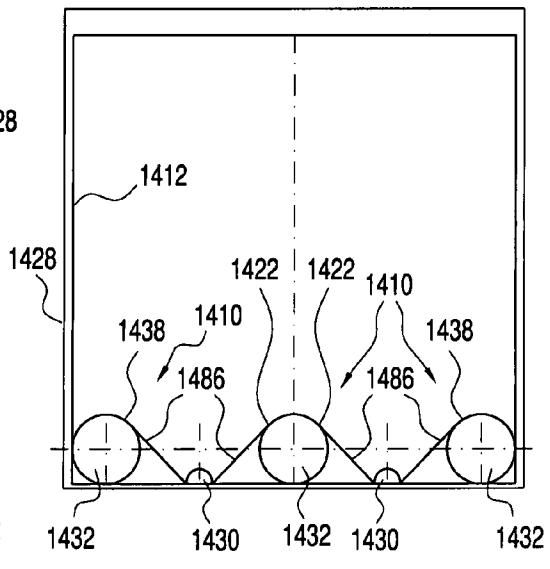
FIG. 18 is a schematic cross-sectional view, similar to that of FIG. 17, showing, however, a ninth embodiment of a bulk material cargo container liner disposed within a bulk material cargo container wherein, in lieu of the inflatable air bag components comprising the multiple-compartment structures as disclosed within FIG. 17, each one of the inflatable air bag components, disposed internally within the bulk material cargo container liner within the corner regions and along the longitudinal centerline region thereof, comprises a single inflatable compartment having a substantially circular cross-sectional configuration when inflated as illustrated.
Figure 19:
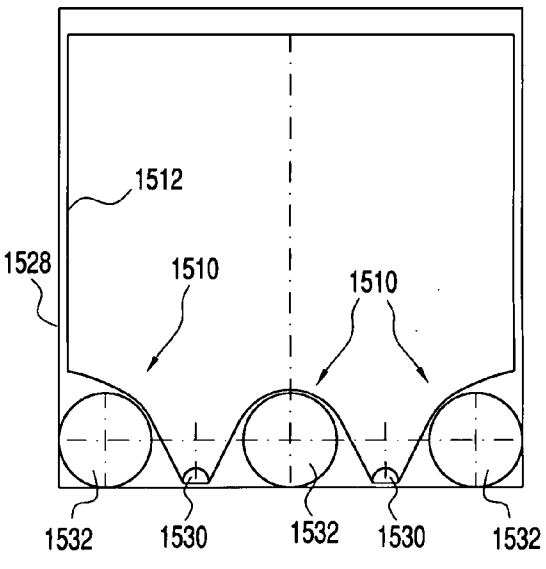
FIG. 19 is a schematic cross-sectional view, similar to that of FIG. 18, showing, however, a tenth embodiment of a bulk material cargo container liner disposed within a bulk material cargo container wherein, in lieu of the single inflatable air bag components being disposed internally within the bulk material cargo container liner and within the corner regions and along the longitudinal centerline region thereof, the single inflatable air bag compartments are disposed externally of the bulk material cargo container liner.

With reference being made to FIG. 18, a ninth embodiment of a bulk material cargo container liner and an inflatable air bag component system is disclosed and is seen to be similar to that disclosed within FIG. 17 except that in lieu of each one of the three inflatable air bag components 1310,1310,1310 comprising a tri-compartment structure, each one of the three inflatable air bag components 1410, 1410,1410 is seen to comprise, in effect, only the primary or main inflatable air bag section or compartment 1432,1432, 1432. In addition, as was the case with each one of the inflatable air bag components 1310,1310,1310 as illustrated within FIG. 17, each one of the inflatable air bag components 1410,1410,1410 may be provided with a suitable additional layer or laminate member 1486 which is disposed along the aforenoted hypotenuse portion 1422,1422,1438,1438 of a respective one of the inflatable air bag components 1410, 1410,1410 so as to protect each one of the inflatable air bag component compartments 1432,1432,1432 from particular bulk cargo materials, such as, for example, pellets or the like, particularly under inflation conditions. Continuing still further, and with reference being made to FIG. 19, a tenth embodiment of a bulk material cargo container liner and an inflatable air bag component system is disclosed and is seen to be similar to that disclosed within FIG. 18 except for the fact that in lieu of each one of the three inflatable air bag components 1410, 1410, 1410 being disposed internally within the bulk material cargo container liner 1412, each one of the three inflatable air bag components 1510,1510,1510 is disposed externally of the bulk material cargo container liner 1512. It is additionally noted that as was the case with the ninth embodiment of the bulk material cargo container liner and an inflatable air bag component system as disclosed within FIG. 18, each one of the three inflatable air bag components 1510,1510,1510 is seen to comprise, in effect, only the primary or main inflatable air bag section or compartment 1532,1532,1532. Accordingly, as is illustrated, when each one of the inflatable air bag components 1510,1510,1510, comprising the primary or main inflatable air bag sections or compartments 1532,1532, 1532, is inflated, the lower corner and axially central regions of the bulk material cargo container liner 1512 will effectively be deformed and moved laterally so as to cause the bulk cargo material to be appropriately moved toward the vacuum discharge tube assemblies 1530,1530.

Figure 21:
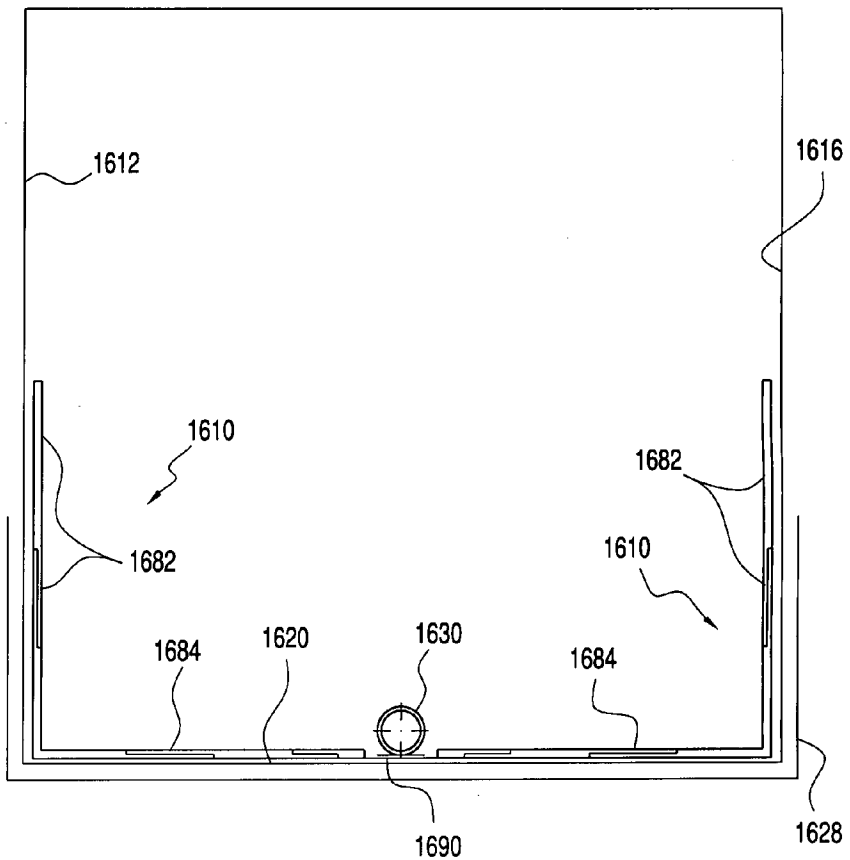
FIG. 21 is a schematic cross-sectional view, corresponding to that of FIG. 20, showing, however, the inflatable air bag components in their deflated states.
Figure 20:
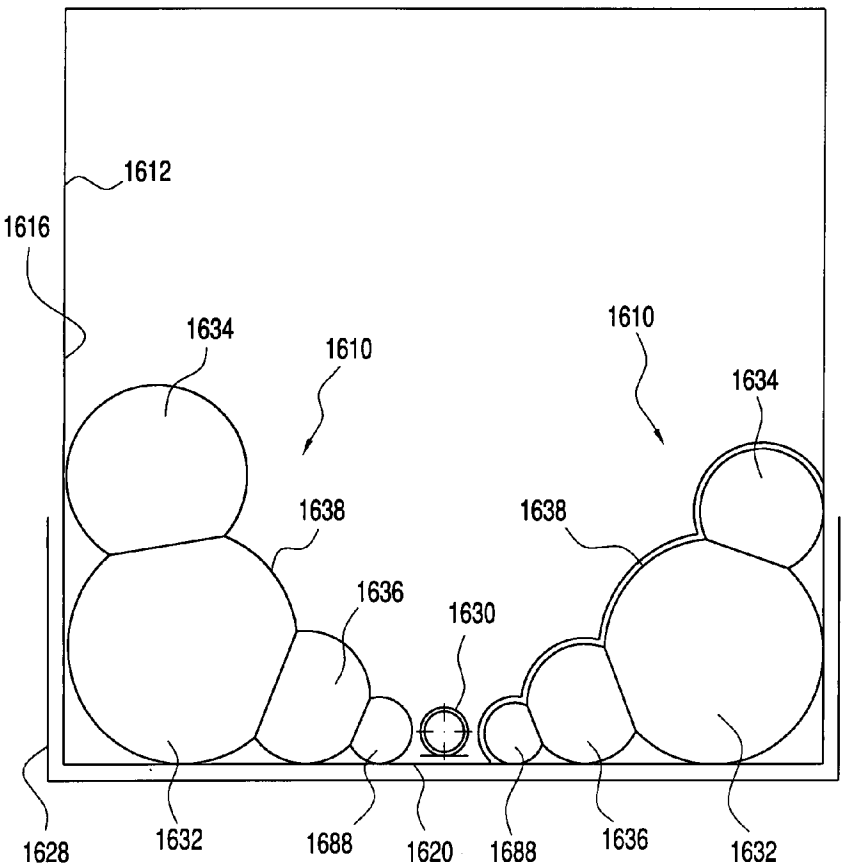
FIG. 20 is a schematic cross-sectional view, similar to that of FIG. 2, showing, however, an eleventh embodiment of a bulk material cargo container liner disposed within a bulk material cargo container wherein, in lieu of the substantially isosceles triangular configuration of the inflatable air bag component disposed within the bulk material cargo container liner as disclosed within FIG. 2, the bulk material cargo container liner has a pair of inflatable air bag components which are disposed internally within the corner regions of the bulk material cargo container liner and which comprise a quadruple array of inflatable compartments which together define a substantially triangular cross sectional configuration when disposed in the inflated states as illustrated.

Still yet further in connection with the particular embodiments of the bulk material cargo container liners which can be disposed within the bulk material cargo containers, and with reference being made to FIGS. 20 and 21, an eleventh embodiment of a bulk material cargo container liner and an inflatable air bag component system is disclosed and is seen to be similar to that disclosed within FIG. 2 in that a pair of inflatable air bag components 1610,1610 are disposed within the oppositely disposed corner regions of the bulk material cargo container liner 1612 so as to cause the bulk cargo material to be moved toward the vacuum discharge tube assembly 1630 disposed at the axially central region of the bulk material cargo container liner 1612. It is additionally noted, however, that in lieu of each one of the inflatable air bag components 1610,1610, having substantially isosceles triangular configurations as was disclosed in connection with the embodiment of FIG. 2, each one of the inflatable air bag components 1610,1610 has a configuration which is somewhat similar to that disclosed within the various embodiments of FIGS. 8-15,17, and 18.

More particularly, it is to be appreciated that in lieu of the triple compartment arrangement of the inflatable air bag components as disclosed within the aforenoted embodiments of FIGS. 8-15,17, and 18, it is seen that each one of the inflatable air bag components 1610,1610 comprises a quadruple array of inflatable compartments which together define a substantially triangular cross sectional configuration when disposed in the inflated states as illustrated. In particular, it is seen that in addition to the provision of the main or primary inflatable air bag compartment 1632 and the pair of secondary or auxiliary inflatable air bag compartments 1634,1636, each one of the inflatable air bag components 1610,1610 also comprises a third secondary or auxiliary inflatable air bag compartment 1688.

The overall external profile of each one of the inflatable air bag components 1610,1610 also defines the hypotenuse regions 1638,1638, and in view of the fact that the third secondary or auxiliary inflatable air bag compartment 1688 is smaller in diametrical extent than that of either one of the pair of secondary or auxiliary inflatable air bag compartments 1634,1636, lower elevational regions of the bulk cargo material disposed within the bulk material cargo container liner 1612 can effectively be moved toward, and evacuated through means of, the vacuum discharge tube assembly 1630 when the inflatable air bag components 1610,1610 are actually inflated as illustrated within FIG. 20. It is lastly noted that, as disclosed in FIG. 21, not only are predetermined regions 1682, 1682,1684,1684 of each one of the primary or main inflatable air bag sections or compartments 1632,1632 of the inflatable air bag components 1610,1610 respectively fixedly secured to the side wall portions 1616, 1616 and the floor or bottom region 1620 of the bulk material cargo container liner 1612, but in addition, the third secondary or auxiliary inflatable air bag compartments 1688, 1688 are connected together as at 1690. In this manner, the proper dispositions or locations of the inflatable air bag components 1610,1610 within the bulk material cargo container liner 1612 are effectively maintained when the inflatable air bag components 1610,1610 are disposed in their deflated states as illustrated within FIG. 21 so as to permit the proper inflation and disposition of the same internally in the bulk material cargo container liner 1612 when the inflatable air bag components 1610,1610 are inflated to their deployed states for use in discharging or exhausting the bulk cargo material from the interior of the bulk material cargo container liner 1612.

Figure 22:
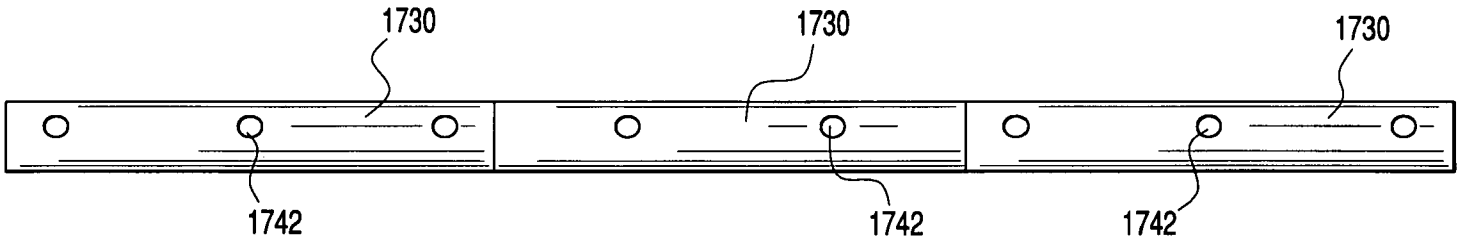
FIG. 22 is a side elevational view of a plurality of vacuum discharge tube assembly sections which are able to be fixedly connected together such that the individual sections can be easily and readily stored and transported and yet be installed on-site within the bulk material cargo container liner.
Figure 23:
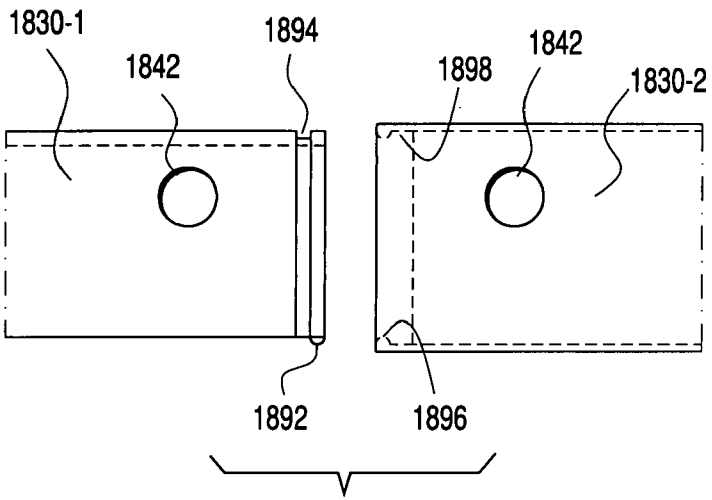
FIG. 23 is a side elevational view of mating end portions of two adjacent vacuum discharge tube assembly sections, similar to those disclosed within FIG. 22, wherein the mating end portions of the vacuum discharge tube assembly sections can be snap-fitted together.
Figure 24:
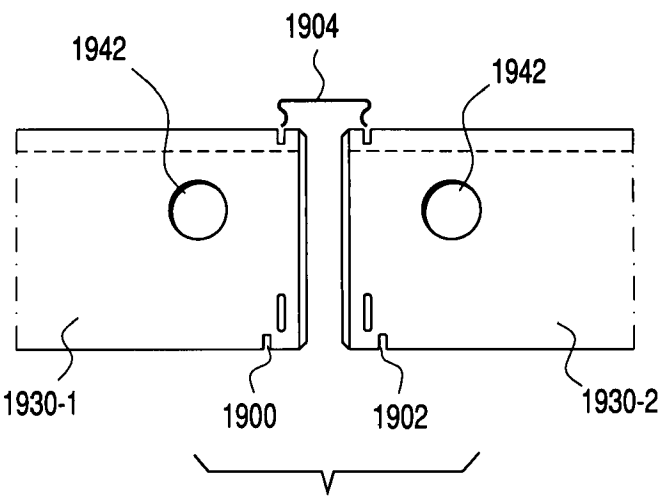
FIG. 24 is a side elevational view of mating end portions of two adjacent vacuum discharge tube assembly sections, similar to those disclosed within FIG. 22, wherein the mating end portions of the vacuum discharge tube assembly sections can be fixedly secured together by suitable annular coupling means.

In order to ease or facilitate the installation of the vacuum discharge tube assemblies within the bulk material cargo container liner, as well as to enable easier storage and transportation of the vacuum discharge tube assemblies prior to the installation of the same within the bulk material cargo container liner, the vacuum discharge tube assemblies are preferably fabricated in sections as disclosed at 1730,1730,1730 within FIG. 22. Each section may have a predetermined length dimension, such as, for example, five feet (5.00'), and as can be seen in FIGS. 23 and 24, various means may be structurally incorporated upon the mating end portions of the vacuum discharge tube assembly sections so as to effectively connect the same together into a longitudinally extending axial array as illustrated within FIG. 22. For example, in accordance with a first embodiment or means for interconnecting the mating end portions of the vacuum discharge tube assembly sections 1830-1,1830-2 as illustrated within FIG. 23, a first one of the vacuum discharge tube assembly sections 1830-1 has an annular, male, radially outwardly extending flange portion 1892 disposed upon one end periphery thereof, and an annular, radially inwardly extending, recessed, female portion 1894 located at an axial position interposed between the flange portion 1892 and the main body portion comprising the vacuum discharge tube assembly section 1830-1, while in a corresponding manner, a second one of the vacuum discharge tube assembly sections 1830-2 has an annular, male, radially inwardly extending flange portion 1896 disposed upon one end periphery thereof, and an annular, radially outwardly extending, recessed, female portion 1898 located at an axial position interposed between the flange portion 1896 and the main body portion comprising the vacuum discharge tube assembly section 1830-2. In this manner, the annular flange portion 1892 of the first one of the vacuum discharge tube assembly sections 1830-1 can be accommodated within the annular recessed portion 1898 of the second one of the vacuum discharge tube assembly sections 1830-2, while, in turn, the annular flange portion 1896 of the second one of the vacuum discharge tube assembly sections 1830-2 can be accommodated within the annular recessed portion 1894 of the first one of the vacuum discharge tube assembly sections 1830-1 whereby adjacent ones of the vacuum discharge tube assembly sections can be fixedly but separably connected together.

In a similar manner, and in accordance with a second embodiment or means for interconnecting the mating end portions of the vacuum discharge tube assembly sections 1930-1,1930-2 as illustrated within FIG. 24, a first one of the vacuum discharge tube assembly sections 1930-1 has an annular, radially inwardly extending, slot 1900 defined within an outer peripheral surface portion of the vacuum discharge tube assembly section 1930-1 and located at an axial position adjacent to one end peripheral face of the vacuum discharge tube assembly section 1930-1, while in a corresponding manner, a second one of the vacuum discharge tube assembly sections 1930-2 has an annular, radially inwardly extending, slot 1902 defined within an outer peripheral surface portion of the vacuum discharge tube assembly section 1930-2 so as to likewise be located at an axial position adjacent to the end peripheral face of the vacuum discharge tube assembly section 1930-2. In addition, a suitably configured annular clip, clamp, or band 1904 is adapted to be disposed around the mating end face portions of the vacuum discharge tube assembly sections 1930-1,1930-2 such that opposite end portions of the clip, clamp, or band 1904 can be disposed within the annular peripheral slots 1900,1902 respectively defined within the end face portions of the vacuum discharge tube assembly sections 1930-1,1930-2 whereby adjacent ones of the vacuum discharge tube assembly sections can in fact be fixedly but separably connected together.

As has been noted hereinbefore in conjunction with the inflatable air bag component and bulk material cargo container liner systems as disclosed, for example, within FIGS. 8-11, the vacuum discharge tube assemblies can have either a fully round or circular cross-sectional configuration, or alternatively a half-round or semi-circular cross-sectional configuration. In connection with those vacuum discharge tube assemblies which have a half-round or semi-circular cross-sectional configuration, such as, for example, the vacuum discharge tube assemblies 730 which are disclosed within FIGS. 8 and 9, such vacuum discharge tube assemblies 730 are inherently stable with respect to their dispositional locations within the bulk material cargo container liners 712, however, it can likewise be appreciated that when those vacuum discharge tube assemblies which have a fully-round or circular cross-sectional configuration, such as, for example, the vacuum discharge tube assemblies 830 which are disclosed within FIGS. 10 and 11, such vacuum discharge tube assemblies 830 are not necessarily inherently stable with respect to their dispositional locations within the bulk material cargo container liners 812.

Figure 25:
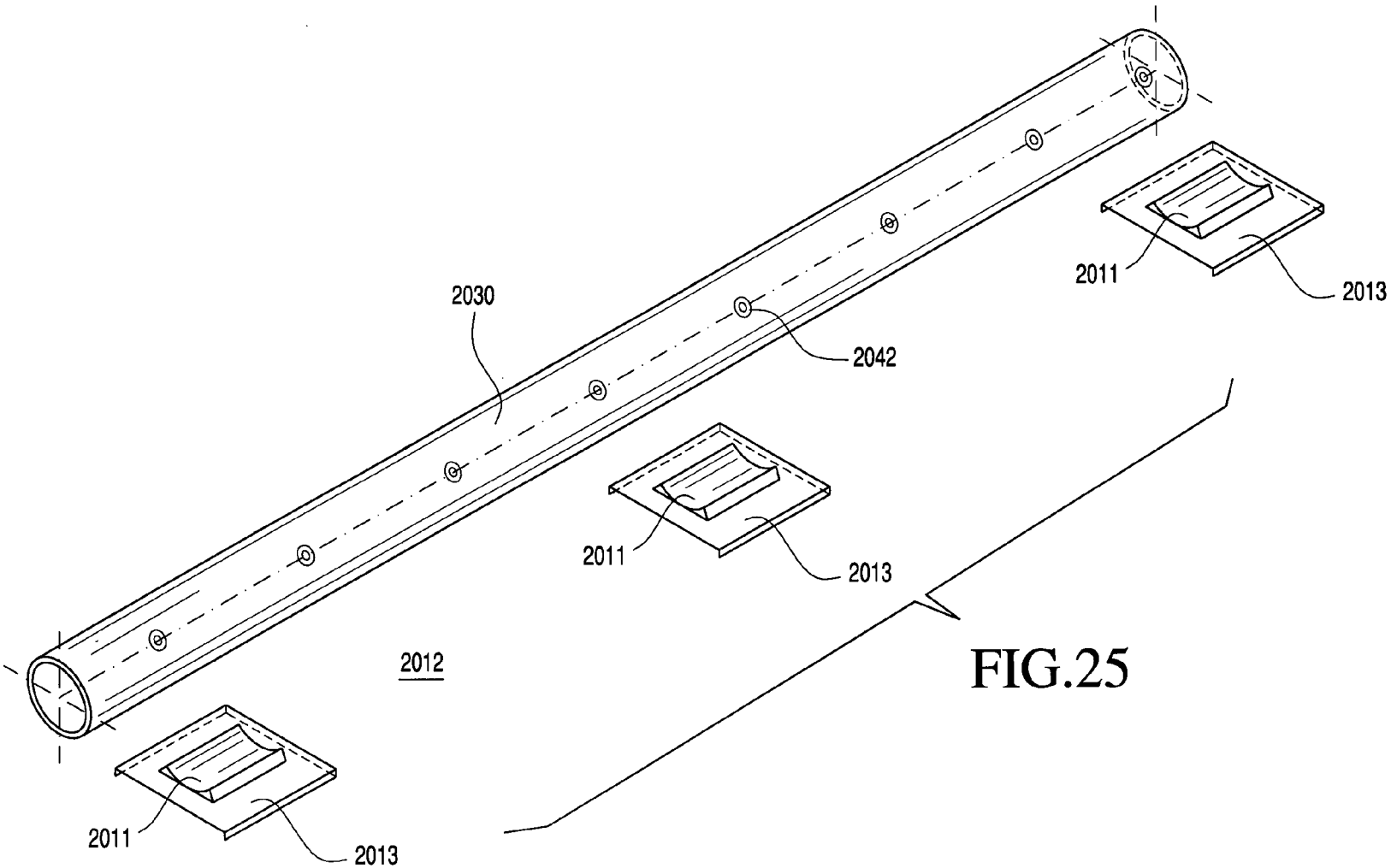
FIG. 25 is a perspective view of one of the vacuum discharge tube assembly sections wherein each one of the vacuum discharge tube assembly sections has a substantially circular cross-sectional configuration and is adapted to be seated upon a plurality of longitudinally spaced support cradles or arcuately-shaped retention blocks in order to substantially retain each one of the vacuum discharge tube assemblies at their desired positions within the bulk material cargo container liner.

Accordingly, in order to maintain the disposition of those vacuum discharge tube assemblies, which have fully-round or circular cross-sectional configurations, at predeterminedly desired locations within the bulk material cargo container liners after the vacuum discharge tube assemblies have been installed within the bulk material cargo container liners, the bottom surface portion or wall member of the bulk material cargo container liner can be provided with suitably configured support members which will in fact serve to retain the vacuum discharge tube assemblies at the predeterminedly desired locations within the bulk material cargo container liners. More particularly, with specific reference being made to FIG. 25, a vacuum discharge tube assembly section 2030, having a circular cross-sectional configuration, is disclosed, and in conjunction with such vacuum discharge tube assembly section 2030, it is seen that a plurality of longitudinally or axially spaced, arcuately configured cradles or saddles 2011 are respectively mounted upon a plurality of support plates 2013 such that the vacuum discharge tube assembly sections 2030 can be seated thereon. The support plates 2013 are preferably mounted internally within the bulk material cargo container liner 2012, however, it is possible that the cradles or saddles 2011 and the support plates 2013 can be fixedly mounted within the bulk material cargo container so as to be disposed externally of the bulk material cargo container liner 2012 whereby the vacuum discharge tube assembly sections 2030 can nevertheless be seated upon the cradles or saddles 2011 so as to effectively be retained at the desired predetermined positions within the bulk material cargo container liner 2012.

Continuing further, as has been noted hereinbefore, and as is well-known in the art and industry, the bulk cargo material disposed internally within the bulk material cargo container liners is adapted to be discharged and exhausted by means of a source of vacuum, not shown, which is operatively and fluidically connected to the rear end portions of the vacuum discharge tube assemblies which are adapted to project outwardly through the rear end wall member of the bulk material cargo container liner. As may therefore be further appreciated, due to well-known pressure differential or pressure drop phenomena or principles, a higher vacuum or suction force level may therefore effectively be impressed upon that portion of the bulk cargo material which is disposed within the vicinity of the rear end wall member of the bulk material cargo container liner as opposed to that portion of the bulk cargo material which is disposed within the vicinity of the front end wall member of the bulk material cargo container liner. Accordingly, if it is determined that only a relatively low, or an insufficient, amount of vacuum or suction force level can be impressed upon that portion of the bulk cargo material which is disposed within the vicinity of the front end wall member of the bulk material cargo container liner whereby that portion of the bulk cargo material which is disposed within the vicinity of the front end wall member of the bulk material cargo container liner cannot necessarily be sufficiently or completely discharged and exhausted, it may be desired to structurally incorporate means within the vacuum discharge tube assemblies which can effectively alter the vacuum or suction force levels that can be generated throughout the longitudinal extent of the overall vacuum discharge tube assemblies between the rear and front wall members of the bulk material cargo container liner whereby, for example, greater vacuum or suction force levels can in fact be generated within the vicinity of the front end wall member of the bulk material cargo container liner.

Figure 26:
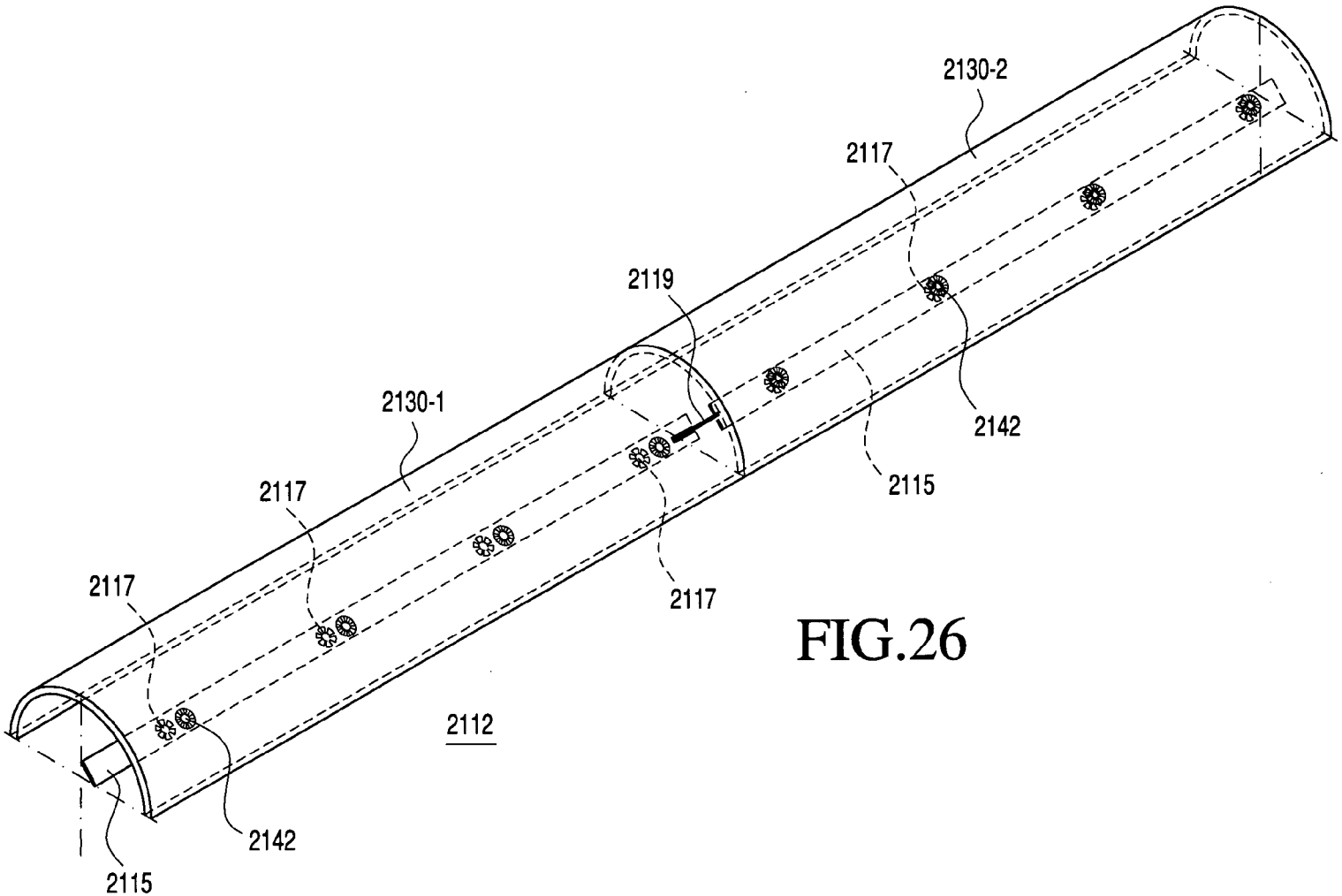
FIG. 26 is a perspective view of two of the vacuum discharge tube assembly sections wherein a first embodiment of an adjustable means is incorporated within the vacuum discharge tube assembly sections for altering the effective size of the aperture openings defined within the vacuum discharge tube assembly sections whereby depending upon the relative disposition of the adjustable means, different vacuum suction levels can be achieved so as to facilitate the discharge of the bulk cargo material from the interior portion of the bulk material cargo container liner.

More particularly, as disclosed within FIG. 26, it is seen that a first means, for altering the effective vacuum or suction force levels that can be impressed upon the bulk cargo material throughout the longitudinal extent of the bulk material cargo container liner, resides in the provision of a pair of apertured strips or plates 2115, only one of which is actually illustrated, within each one of the vacuum discharge tube assembly sections 2130-1,2130-2 such that the apertured strips or plates 2115 are respectively movably mounted upon the interior portion of each one of the vacuum discharge tube assembly sections 2130-1,2130-2 between EXTENDED and RETRACTED positions. Each one of the strips or plates 2115 is provided with a plurality of longitudinally or axially spaced apertures 2117, and accordingly, depending upon the relative disposition of the strips or plates 2115 with respect to the vacuum discharge tube assembly sections 2130-1,2130-2, the apertures 2117 defined within the strips or plates 2115 can either be aligned with respect to, for example, the apertures 2142 defined within the peripheral side portions of a particular one of the vacuum discharge tube assembly sections, as disclosed, for example, in connection with vacuum discharge tube assembly section 2130-2, or alternatively, the apertures 2117 defined within the strips or plates 2115 can be misaligned with respect to, for example, the apertures 2142 defined within the peripheral side portions of a particular one of the vacuum discharge tube assembly sections, as disclosed, for example, in connection with vacuum discharge tube assembly section 2130-1.

It may therefore be appreciated that when the apertures 2117 defined within a particular one of the strips or plates 2115 are misaligned with respect to the apertures 2142 defined within a particular one of the vacuum discharge tube assembly sections, such as, for example, in connection with the strip or plate 2115 and the vacuum discharge tube assembly section 2130-1, air flow from the interior portion of the bulk material cargo container liner 2112 and through the apertures 2142 defined within the vacuum discharge tube assembly section 2130-1 is effectively blocked, whereas, conversely, when the apertures 2117 defined within a particular one of the strips or plates 2115 are aligned with respect to the apertures 2142 defined within a particular one of the vacuum discharge tube assembly sections, such as, for example, the vacuum discharge tube assembly section 2130-2, air flow from the interior portion of the bulk material cargo container liner 2112 and through the apertures 2142 defined within the vacuum discharge tube assembly section 2130-2 is effectively permitted. Accordingly, different levels of vacuum or suction force are able to be generated and impressed upon different regions of the bulk cargo material disposed within the bulk material cargo container liner 2112 so as to facilitate and ensure the discharge and exhaust of the bulk cargo material from all longitudinal or axial regions of the bulk material cargo container liner 2112. It is lastly noted in connection with this adjustment system that the strips or plates 2115,2115 disposed within adjacent ones of the vacuum discharge tube assembly sections 2130-1,2130-2 may be interconnected together by suitable means, such as, for example, a slot and strap assembly 2119. In this manner, the strips or plates 2115,2115 may be moved to, or disposed at, various longitudinal or axial positions as desired or required.

Figure 27:
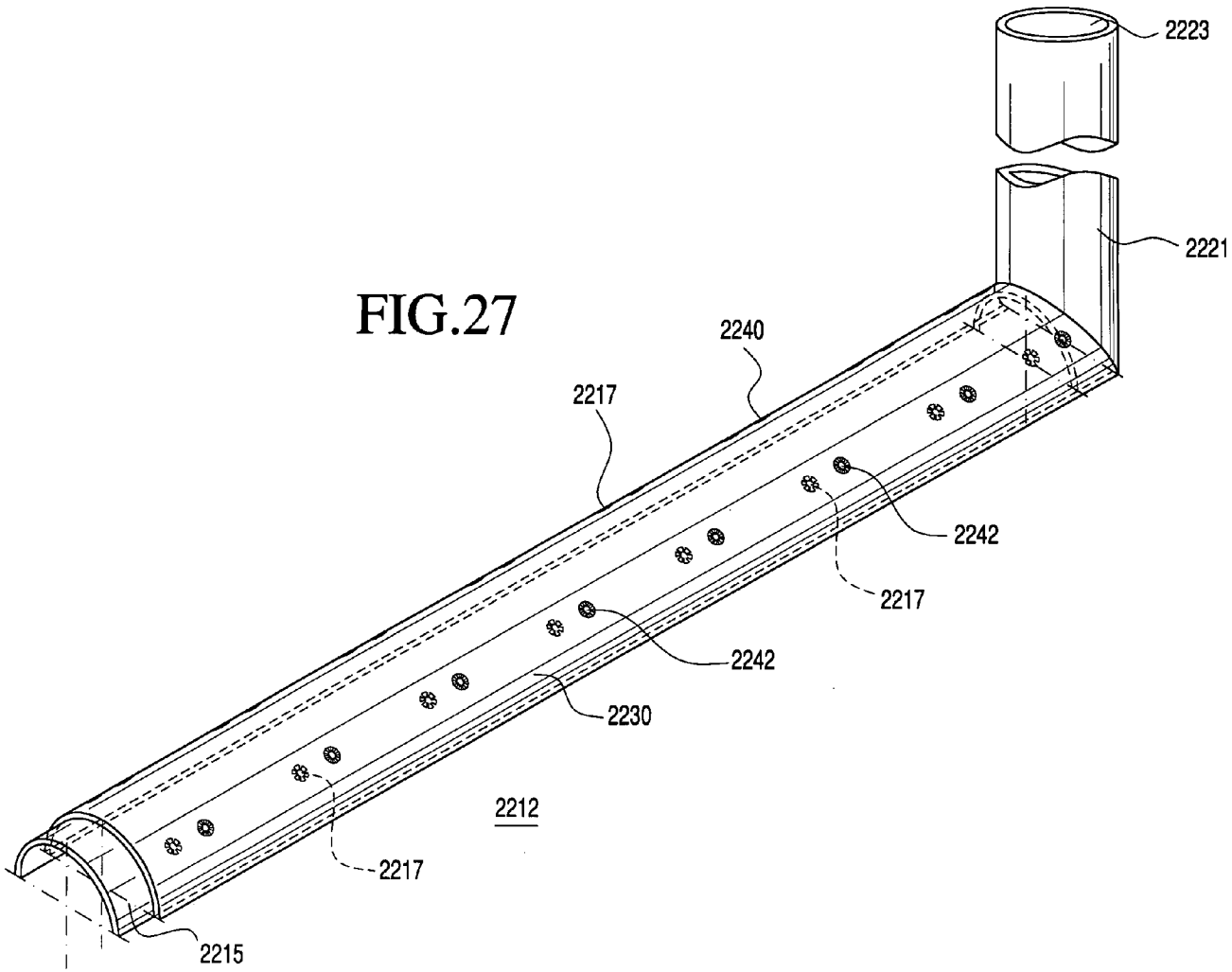
FIG. 27 is a perspective view of one of the vacuum discharge tube assembly sections wherein a second embodiment of an adjustable means is incorporated within the vacuum discharge tube assembly sections for, again, altering the effective size of the aperture openings defined within the vacuum discharge tube assembly sections whereby depending upon the relative disposition of the adjustable means, different vacuum suction levels can be achieved so as to facilitate the discharge of the bulk cargo material from the interior portion of the bulk material cargo container liner.

With reference now being made to FIG. 27, it is seen that a second means, for altering the effective vacuum or suction force levels that can be impressed upon the bulk cargo material throughout the longitudinal extent of the bulk material cargo container liner, resides in the provision of an apertured sleeve member 2215 within each one of the vacuum discharge tube assembly sections 2230 such that the apertured sleeve member 2215 is respectively movably mounted within the interior portion of each one of the vacuum discharge tube assembly sections 2230 between EXTENDED and RETRACTED positions. The sleeve members 2215 are similar to the aforenoted strips or plates 2115 in that each one of the sleeves 2215 is provided with two sets of longitudinally or axially spaced apertures 2217, only one set being visible, and accordingly, depending upon the relative disposition of the sleeves 2215 with respect to the vacuum discharge tube assembly sections 2230, the apertures 2217 defined within the sleeves 2215 can either be aligned with respect to, for example, the apertures 2240, 2242 defined within the peripheral side portions of a particular one of the vacuum discharge tube assembly sections 2230, or alternatively, the apertures 2117 defined within the sleeves 2215 can be misaligned with respect to, for example, the apertures 2240,2242 defined within the peripheral side portions of a particular one of the vacuum discharge tube assembly sections 2230.

It may therefore be appreciated that when the apertures 2217 defined within a particular one of the sleeves 2215 are misaligned with respect to the apertures 2240,2242 defined within a particular one of the vacuum discharge tube assembly sections 2230, air flow from the interior portion of the bulk material cargo container liner 2212 and through the apertures 2240,2242 defined within the vacuum discharge tube assembly section 2230 is effectively blocked, whereas, conversely, when the apertures 2217 defined within a particular one of the sleeves 2215 are aligned with respect to the apertures 2240,2242 defined within a particular one of the vacuum discharge tube assembly sections 2230, air flow from the interior portion of the bulk material cargo container liner 2212 and through the apertures 2240,2242 defined within the vacuum discharge tube assembly section 2230 is effectively permitted. Accordingly, again, different levels of vacuum or suction force are able to be generated and impressed upon different regions of the bulk cargo material disposed within the bulk material cargo container liner 2212 so as to facilitate and ensure the discharge and exhaust of the bulk cargo material from all longitudinal or axial regions of the bulk material cargo container liner 2212. It is also noted, in connection with this adjustment system, that the diametrical size of the apertures 2217,2240,2242, which are respectively defined within the sleeve member 2215 and the vacuum discharge tube assembly section 2230, may be varied so as to readily permit, for example, partial closure of the apertures 2217,2240,2242 and partial blockage of the air flow therethrough. In addition, the pitch or distance defined between successive ones of the apertures 2217,2240,2242 may likewise be varied. Such variations permit different vacuum or suction force levels to be attained within the vacuum discharge tube assembly sections 2230, and such variations may likewise also be incorporated within the strips or plates 2115 as disclosed in connection with the embodiment illustrated within FIG. 26.

It is lastly noted that, in connection with the different bulk cargo materials that are being transported within the bulk material cargo container liners, it is sometimes easier to discharge and exhaust particular types of bulk cargo materials than other types of bulk cargo materials. For example, in connection with the disposition of relatively coarse bulk cargo materials, such as, for example, pellets, tablets, or the like, within the bulk material cargo container liner, a substantially large volume of air is effectively present within the entire or overall bulk cargo material load in view of the fact that the air can permeate all of the spaces or interstices defined between individual ones of adjacent or abutting units, that is, the pellets, tablets, or the like, which comprise the bulk cargo material load. Accordingly, when such bulk cargo material is to be discharged and exhausted through means of the vacuum discharge tube assembly, the air present within the entire or overall bulk cargo material load is able to flow and effectively entrain the bulk cargo material therewith and therealong so as to in fact carry, discharge, and exhaust the bulk cargo material out from the bulk material cargo container liner. On the other hand, when the bulk cargo material comprises relatively fine material, such as, for example, powdery materials or the like, there is a relatively small volume of air present within the entire or overall bulk cargo material load in view of the fact that the minute particles, comprising such powdery type bulk cargo material, are in effect packed together so densely that substantially sized spaces or interstices, into which the air can readily permeate, simply do not exist. Therefore, when such bulk cargo materials are to be discharged and exhausted from the bulk material cargo container liner, the vacuum or suction forces cannot develop the necessary air flow within the bulk cargo material so as to entrain the bulk cargo material therealong.

Accordingly, in order to rectify the aforenoted deficiency in connection with the discharge and exhaust of powdery type bulk cargo materials, a vertically oriented standpipe 2221, as shown in FIG. 27, is structurally and fluidically connected to the forwardmost end portion of the forwardmost vacuum discharge tube assembly section 2230. The upper end portion 2223 of the vertically oriented standpipe 2221 is adapted to be disposed above the upper level portion of the bulk cargo material disposed within the bulk material cargo container liner 2212, and in this manner, ambient air is always effectively present within the front end portion of the forwardmost vacuum discharge tube assembly section 2230 so as to effectively exert atmospheric pressure upon any bulk cargo material present within the entire vacuum discharge tube assembly 2230. Such atmospheric air fluidically cooperates with the vacuum or suction forces operating at the rearward end of the vacuum discharge tube assembly 2230, and accordingly, even powdery type bulk cargo material can be readily discharged and exhausted from the bulk material cargo container liner 2212.

Figure 28:
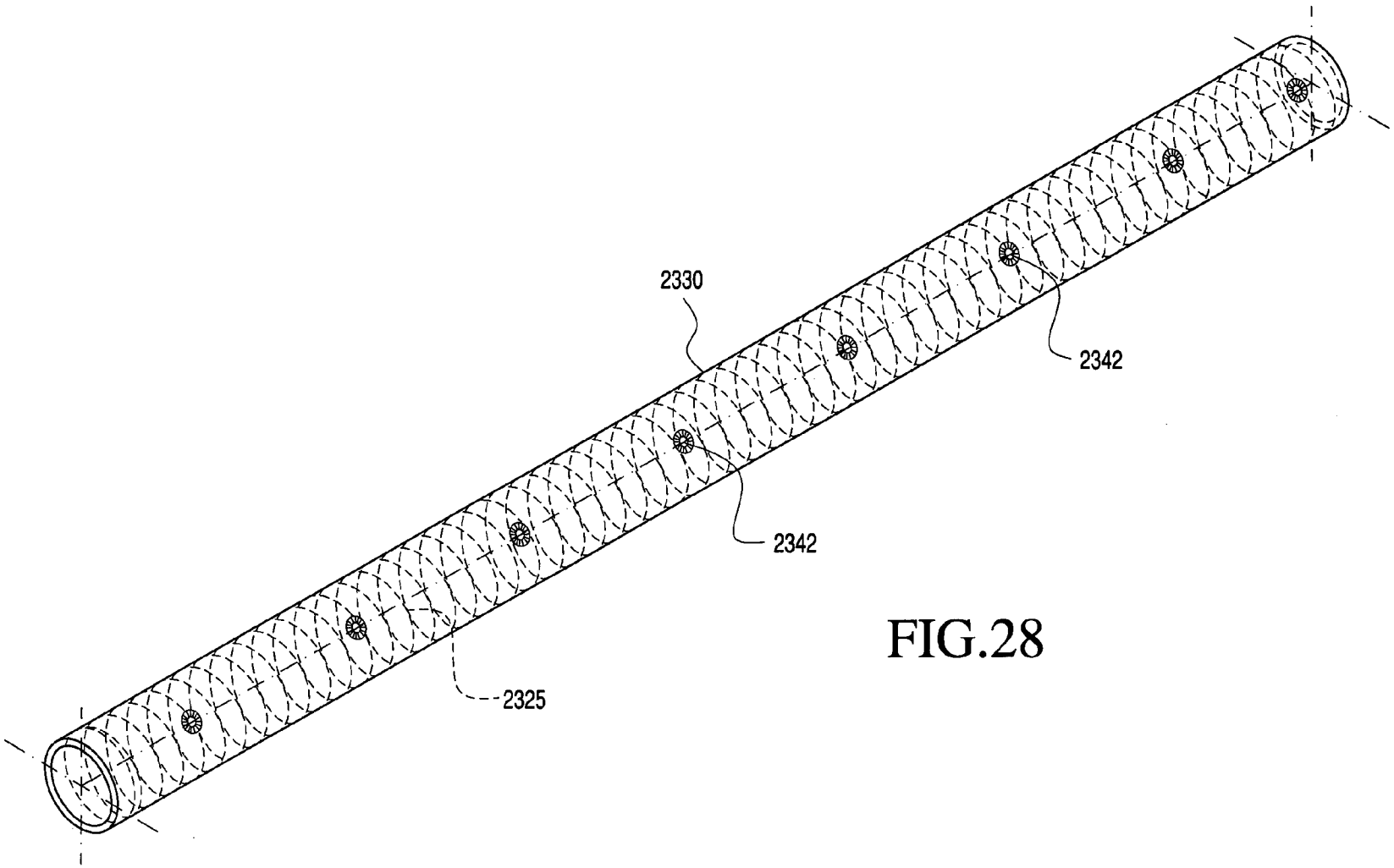
FIG. 28 is a perspective view of a first alternative embodiment of a vacuum discharge tube assembly, which may be utilized within any one of the bulk material cargo container liners as desired, wherein the vacuum discharge tube assembly has a substantially circular cross-sectional configuration and is provided internally with a coil spring member in order to effectively prevent the internal collapse of the vacuum discharge tube assembly as well as to facilitate the preservation of the tubular configuration of the vacuum discharge tube assembly despite bending or coiling of the same during, for example, the storage or transportation of the vacuum discharge tube assembly prior to the installation of the same within the bulk material cargo container liner.
Figure 29:
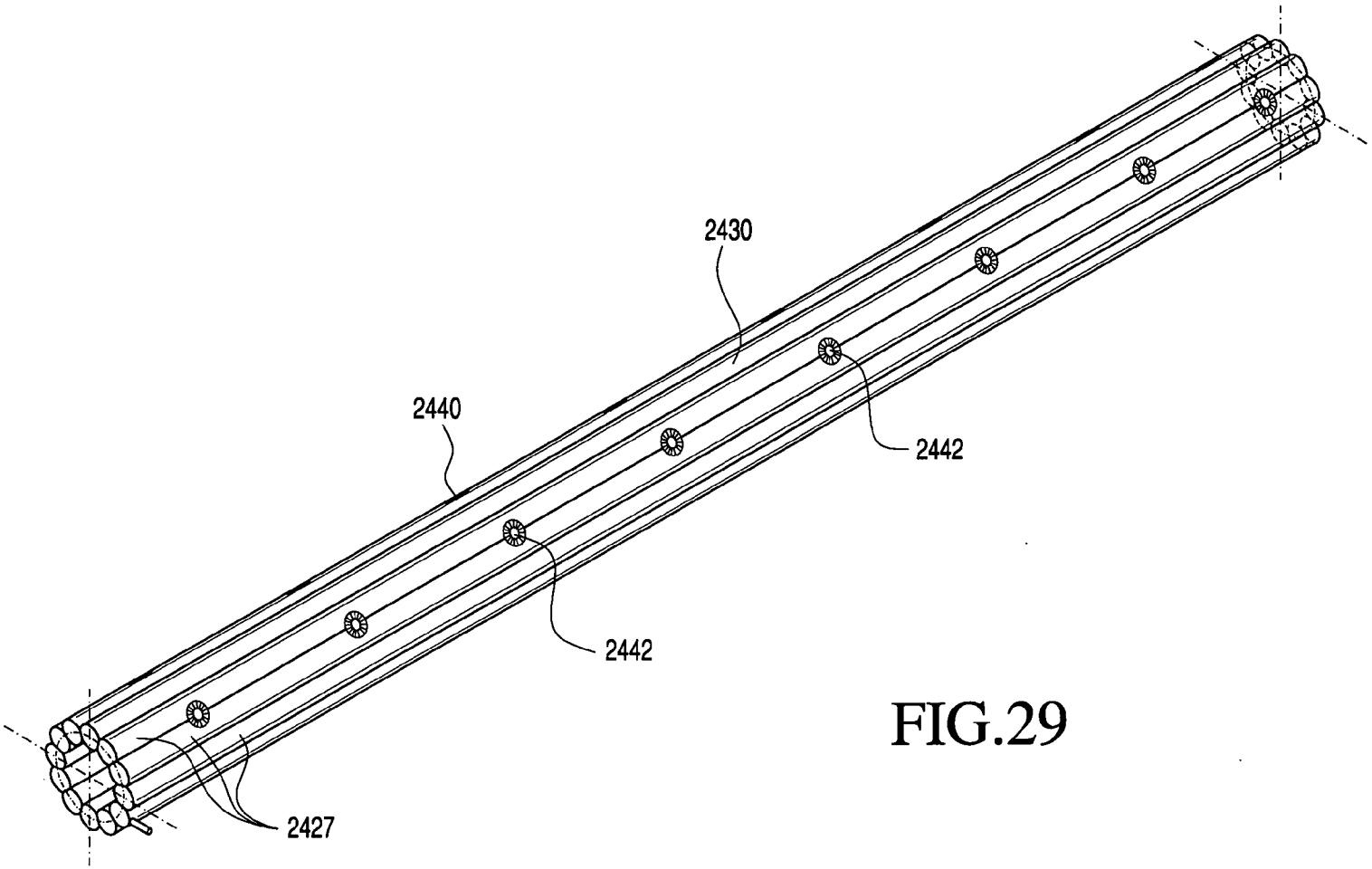
FIG. 29 is a perspective view of a second alternative embodiment of a vacuum discharge tube assembly which has, for example, a circular cross-sectional configuration and which comprises a plurality of inflatable tubular members which are arranged within an annular array so as to effectively define the overall vacuum discharge tube assembly.

Continuing further, and in connection with the actual fabrication of any one of the previously disclosed vacuum discharge tube assemblies, several additional embodiment modes or techniques are envisioned in accordance with the principles and teachings of the present invention and are disclosed within FIGS. 28 and 29. For example, as disclosed within FIG. 28, it is seen that each one of the vacuum discharge tube assembly sections 2330 has a coil spring member 2325 which is disposed internally thereof and which extends throughout the entire longitudinal or axial extent of each vacuum discharge tube assembly section 2330. In this manner, the coil spring members 2325 effectively help to prevent the internal collapse of any one of the vacuum discharge tube assembly sections 2330, not only when the vacuum discharge tube assembly sections 2330 are disposed internally within bulk material cargo container liners, and when the bulk material cargo container liners have bulk cargo material disposed therein, but in addition, the disposition or presence of the coil spring members 2325 internally within the vacuum discharge tube assembly sections 2330 effectively prevent the internal collapse of the same while the vacuum discharge tube assembly sections 2330 are being bent, flexed, coiled, or the like, during, for example, handling or storage of the same. Alternatively, in accordance with the embodiment as disclosed within FIG. 29, each one of the vacuum discharge tube assembly sections 2430 may be fabricated from a plurality of inflatable tubular members 2427 which are connected together along axially or longitudinally extending peripheral surface portions whereby the plurality of inflatable tubular members 2427 are disposed within an annular array. In this manner, the plurality of inflatable tubular members 2427 together define each one of the vacuum discharge tube assembly sections 2430 as a composite structure. The plurality of inflatable tubular members 2427 may be fluidically separated from each other whereby the plurality of inflatable tubular members 2427 would be individually and separately inflated, or alternatively, they may be fluidically connected together so as to be capable of being inflated simultaneously. In addition, it is noted that the annular array of the inflatable tubular members 2427 defining each one of the composite vacuum discharge tube assembly sections 2430 comprises twelve of the inflatable tubular members 2427, however, this number may be varied as desired so as to comprise either a greater number of inflatable tubular members 2427 or a lesser number of inflatable tubular members 2427.

Figure 30:
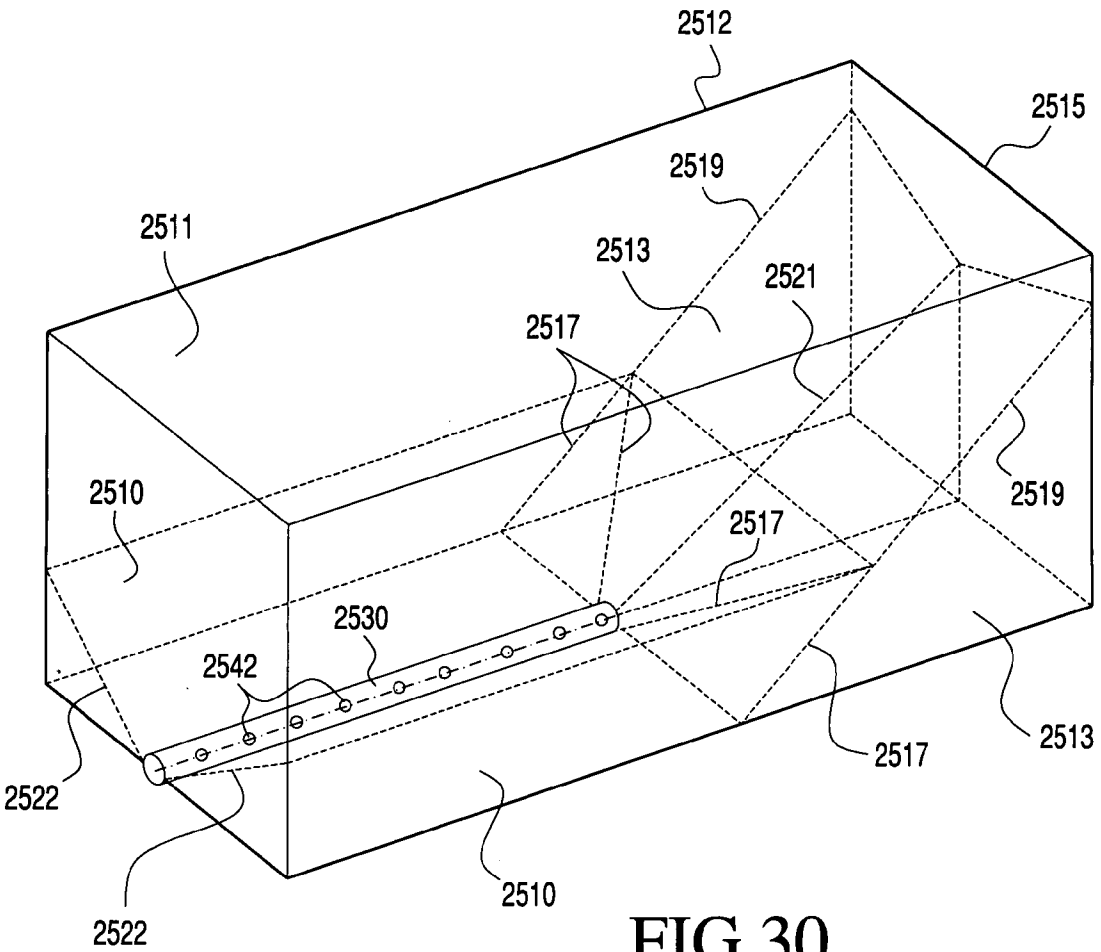
FIG. 30 is a schematic perspective view, similar to that of FIG. 1, showing, however, a twelfth embodiment of a new and improved bulk material cargo container liner which has been constructed in accordance with the principles and teachings of the present invention so as to comprise an axially oriented vacuum discharge tube assembly, which only extends from the rear wall member of the bulk material cargo container liner to a substantially central region of the bulk material cargo container liner, and a plurality of inflatable air bag components for directing the bulk cargo material toward a plurality of intake ports defined within the vacuum discharge tube assembly in order to facilitate the discharge or unloading of the bulk cargo materials from the bulk material cargo container liner without necessitating any operative tilting of the bulk material cargo container.

With reference now being made to FIG. 30, and returning to a description of additional embodiments of bulk material cargo container liners which can be disposed within the bulk material cargo containers, a twelfth embodiment of a bulk material cargo container liner and inflatable air bag component system is disclosed wherein it is to be appreciated that in lieu of the inflatable air bag components, as well as the vacuum discharge tube assembly, extending the entire axial length of the bulk material cargo container liner, from the rear wall member of the bulk material cargo container liner to the front wall member of the bulk material cargo container liner, as was the case with all of the previously described embodiments of the bulk material cargo container liners, and the inflatable air bag and vacuum discharge tube assemblies disposed therein, it is seen that, in accordance with the principles and teachings of the bulk material cargo container liner 2512, the axially oriented vacuum discharge tube assembly 2530 extends only from the rear wall member 2511 of the bulk material cargo container liner 2512 to a central region of the bulk material cargo container liner 2512. The axially oriented vacuum discharge tube assembly 2530 has a plurality of axially spaced apertures 2542 defined therein, and a first pair of inflatable air bag components 2510,2510 are disposed within substantially the rear half portion of the bulk material cargo container liner 2512 so as to effectively extend from the rear wall member 2511 of the bulk material cargo container liner 2512 to the central region of the bulk material cargo container liner 2512.

The first pair of inflatable air bag components 2510,2510 are located within the oppositely disposed rearward corner regions of the bulk material cargo container liner 2512, and it is seen that each one of the first pair of inflatable air bag components 2510,2510 has a substantially right-triangular cross-sectional configuration, as considered along transverse directions or planes, such that the oppositely disposed hypotenuse portions 2522,2522 thereof cause the bulk cargo material, disposed within the bulk material cargo container 2512, to be moved toward the axially oriented vacuum discharge tube assembly 2530 when the first pair of inflatable air bag components 2510,2510 are in fact inflated. Continuing further, and in a similar manner, it is additionally seen that a second pair of inflatable air bag components 2513,2513 are disposed within substantially the front half portion of the bulk material cargo container liner 2512 so as to effectively extend from the front wall member 2515 of the bulk material cargo container liner 2512 to the central region of the bulk material cargo container liner 2512, it of course being appreciated that the forward end portions of the first pair of inflatable air bag components 2510,2510 effectively and respectively mate with the rear end portions of the second pair of the inflatable air bag components 2513,2513 along inclined loci 2517,2517.

The second pair of inflatable air bag components 2513, 2513 are similarly located within the oppositely disposed forward corner regions of the bulk material cargo container liner 2512, and it is seen that each one of the second pair of inflatable air bag components 2513,2513 has a substantially right-triangular cross-sectional configuration, as considered along axially oriented planes or directions, such that the hypotenuse portions 2519,2519 thereof cause the bulk cargo material, disposed within the bulk material cargo container liner 2512, to be moved toward the rearward end portion of the bulk material cargo container liner 2512 when the second pair of inflatable air bag components 2513,2513 are in fact inflated. It is particularly noted still further that not only are the hypotenuse portions 2519,2519 of the second pair of inflatable air bag components 2513,2513 inclined toward the rear end portion of the bulk material cargo container liner 2512, but they are also oppositely inclined with respect to each other and toward the central axis of the bulk material cargo container liner 2512 so as to meet or interface along an axially located locus 2521. In this manner, when the second pair of inflatable air bag components 2513,2513 are in fact inflated, the hypotenuse portions 2519,2519 will cause the bulk cargo material, disposed within the bulk material cargo container liner 2512, to move toward the front or upstream intake end portion of the vacuum discharge tube assembly 2530.

Figure 31:
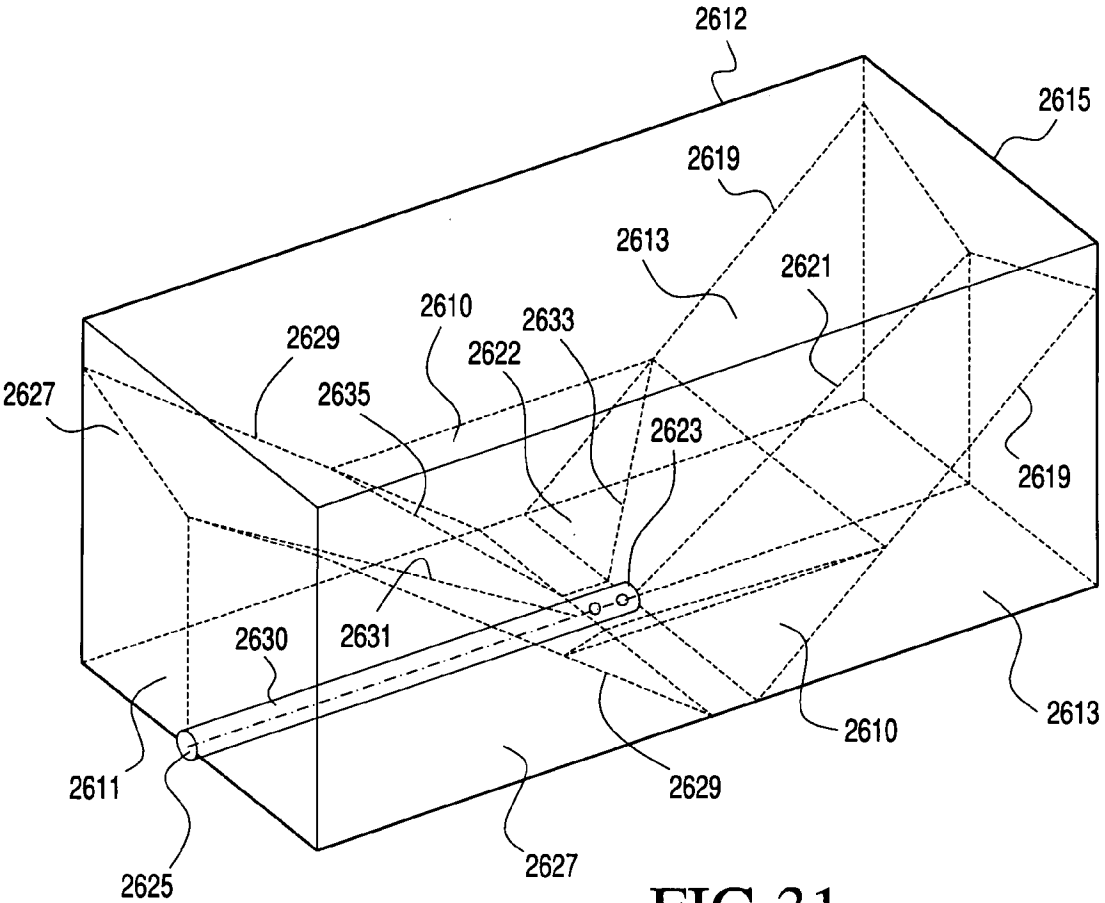
FIG. 31 is a schematic perspective view, similar to that of FIG. 30, showing, however, a thirteenth embodiment of a new and improved bulk material cargo container liner which has been constructed in accordance with the principles and teachings of the present invention so as to comprise an axially oriented vacuum discharge tube assembly, which only extends from the rear wall member of the bulk material cargo container liner to a substantially central region of the bulk material cargo container liner and which has only a single intake port, and a plurality of inflatable air bag components effectively disposed around the perimeter of the bulk material cargo container liner for directing the bulk cargo material toward the single intake port of the vacuum discharge tube assembly in order to facilitate the discharge or unloading of the bulk cargo materials from the bulk material cargo container liner without necessitating any operative tilting of the bulk material cargo container.

Turning now to FIG. 31, a thirteenth embodiment of a bulk material cargo container liner, and an inflatable air bag component system disposed therein, is disclosed, and it is to be appreciated that in a manner similar to that of the twelfth embodiment of the bulk material cargo container liner and the inflatable air bag component system as disclosed within FIG. 30, an axially oriented vacuum discharge tube assembly 2630 again extends only from the rear wall member 2611 of the bulk material cargo container liner 2612 to a central region of the bulk material cargo container liner 2612. There are, however, differences between the two systems or embodiments as disclosed within FIGS. 30 and 31. For example, it is noted that in lieu of the axially oriented vacuum discharge tube assembly 2630 being apertured along its axial extent, the vacuum discharge tube assembly 2630 is imperforate along its axial extent and is only effectively provided with a single intake port 2623 at the upstream or forward end portion thereof, and of course the discharge port 2625 at the rearward or downstream end portion thereof. In addition, it is seen that the first pair of inflatable air bag components 2610,2610 are no longer disposed within substantially the rear half portion of the bulk material cargo container liner 2612 but, to the contrary, are disposed within axially central portions of the bulk material cargo container liner 2612 such that the hypotenuse portions 2622,2622 thereof effectively convey the bulk cargo material toward the single intake port 2623 of the vacuum discharge tube assembly 2630 when the first pair of inflatable air bag components 2610,2610 are inflated.

Still further, it is seen that a third pair of inflatable air bag components 2627,2627 are in fact disposed within the rear half portion of the bulk material cargo container liner 2612 so as to extend from the rear wall member 2611 of the bulk material cargo container liner 2612 to the central region of the bulk material cargo container liner 2612. It is to be appreciated that the third pair of inflatable air bag components 2627, 2627 have substantially the same structures as those of the second pair of inflatable air bag components 2613,2613 and are disposed directly opposite the second pair of inflatable air bag components 2613, 2613. The hypotenuse portions 2629, 2629 of the third pair of inflatable air bag components 2627, 2627 are inclined toward the front end portion of the bulk material cargo container liner 2612, as well as being inclined toward each other so as to meet along axially located interface 2631, and in this manner, the respective hypotenuse portions 2619,2619 and 2629,2629 of the second and third pairs of inflatable air bag components 2613,2613 and 2627,2627 will effectively cooperate with the hypotenuse portions 2622,2622 of the first pair of inflatable air bag components 2610,2610 so as to cause the bulk cargo material to flow toward the single vacuum discharge tube assembly outlet port 2623 when the first, second, and third pairs of inflatable air bag components 2610,2610,2613,2613,2627,2627 are inflated. It is lastly noted that the first pair of inflatable air bag components 2610,2610 respectively meet with the second and third pairs of inflatable air bag components along interfaces 2633,2633 and 2635,2635 so as to in fact facilitate the smooth flow of the bulk cargo material toward the single intake port 2623 of the vacuum discharge tube assembly 2630.

Figure 32:
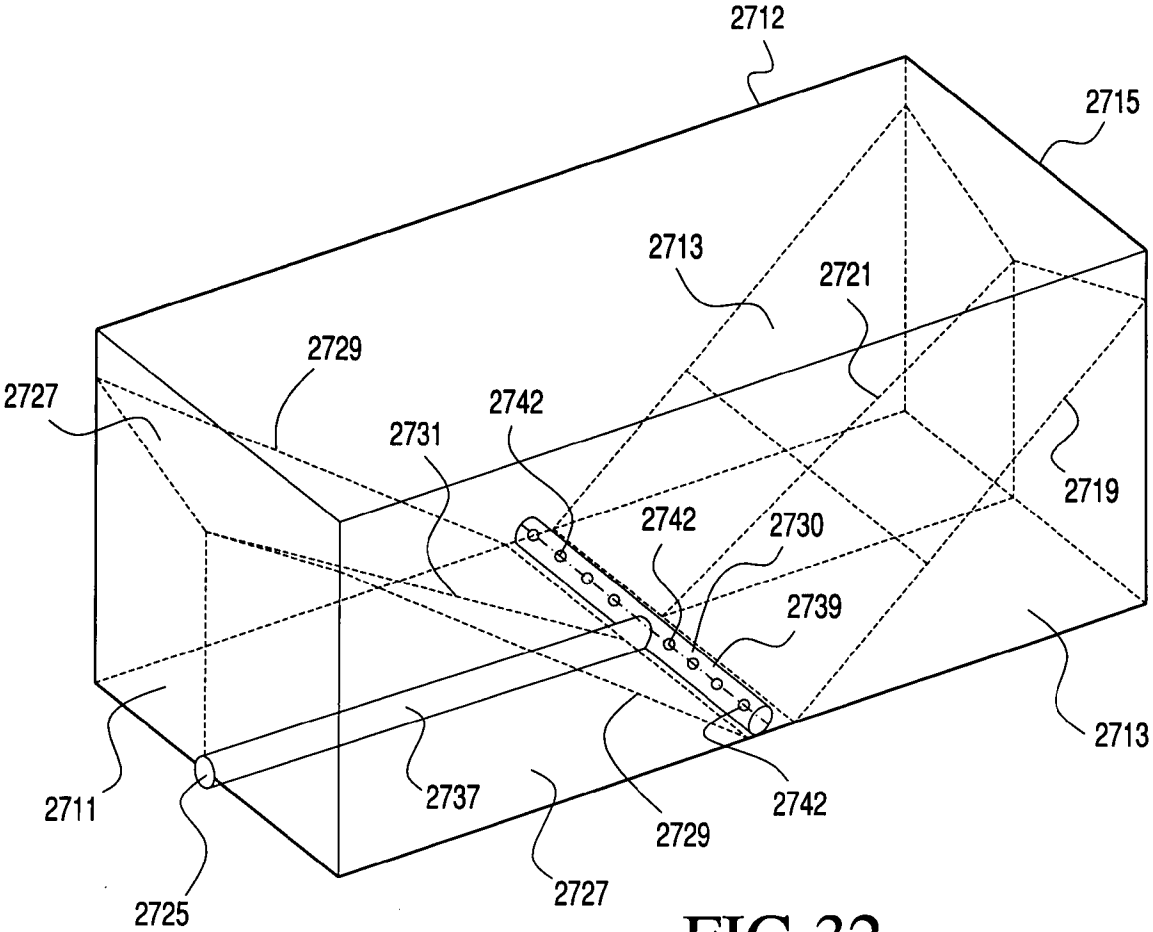
FIG. 32 is a schematic perspective view, similar to that of FIGS. 30 and 31, showing, however, a fourteenth embodiment of a new and improved bulk material cargo container liner which has been constructed in accordance with the principles and teachings of the present invention so as to comprise a substantially T-shaped vacuum discharge tube assembly which only extends from the rear wall member of the bulk material cargo container liner to a substantially central region of the bulk material cargo container liner, and a plurality of inflatable air bag components for directing the bulk cargo material toward the vacuum discharge tube assembly in order to facilitate the discharge or unloading of the bulk cargo materials from the bulk material cargo container liner without necessitating any operative tilting of the bulk material cargo container.

With reference lastly being made to FIG. 32, a fourteenth embodiment of a bulk material cargo container liner, and an inflatable air bag component system disposed therein, is disclosed, and it is noted that in the interest of brevity, the detailed description of this embodiment of the bulk material cargo container liner, and the inflatable air bag component system disposed therein, will be confined to the differences between the structures of this embodiment as compared to, for example, the structures of the embodiments previously disclosed within FIGS. 30 and 31. In addition, it is to be noted that structural features of this embodiment, which correspond to similar structural features characteristic of the embodiments disclosed within FIGS. 30 and 31, will be denoted by corresponding reference characters except that they will be within the 2700 series. Accordingly, it is to be appreciated that in a manner similar to that characteristic of the twelfth and thirteenth embodiments of the bulk material cargo container liners and the inflatable air bag component systems as disclosed within FIGS. 30 and 31, the vacuum discharge tube assembly 2730 again extends only from the rear wall member 2711 of the bulk material cargo container liner 2712 to a central region of the bulk material cargo container liner 2712. There are, however, differences between the system or embodiment as disclosed within FIG. 32 and the two systems or embodiments as disclosed within FIGS. 30 and 31.

For example, it is noted that in lieu of the vacuum discharge tube assembly 2730 extending only axially within the bulk material cargo container liner 2712, it is seen that the vacuum discharge tube assembly 2730 has a substantially T-shaped configuration wherein, in addition to comprising an axially oriented section 2737, the vacuum discharge tube assembly 2730 also comprises a cross-piece or transversely oriented section 2739. It is noted that the axially oriented section 2737 of the vacuum discharge tube assembly 2730 is imperforate, except for the outlet or discharge port 2725 located within the rearward or downstream end portion of the axially oriented section 2737, while the transversely oriented section 2739 is provided with a transversely spaced array of apertures 2742, the laterally central portion of the transversely oriented section 2739 of the vacuum discharge tube assembly 2730 of course being fluidically connected to the forward or upstream end portion of the axially oriented section 2737 of the vacuum discharge tube assembly 2730. Still further, it is seen that only pairs of inflatable air bag components 2713,2713, and 2727,

2727, similar to the second and third pairs of inflatable air bag components 2613,2613,2627,2627 as disclosed within the embodiment of FIG. 31, are employed within the bulk material cargo container liner 2712 such that when the pairs of inflatable air bag components 2713,2713, and 2727,2727 are in fact inflated, the bulk cargo material will effectively be conveyed toward the apertures 2742 defined within the transversely oriented section 2739 of the vacuum discharge tube assembly 2730.

Having disclosed the aforenoted various structures comprising the inflatable air bag components, the vacuum discharge tube assemblies, and the overall bulk material cargo container liner systems with which the inflatable air bag components and the vacuum discharge tube assemblies are to be utilized, a brief description of the operation of the bulk material cargo container liner systems, having the inflatable air bag components and the vacuum discharge tube assemblies associated therewith, will now be described. It is to be appreciated, for example, that when a bulk material cargo load is initially loaded or charged into any one of the bulk material cargo container liners, the vacuum discharge tube assemblies, comprising either, in effect, their semi-circular or circular cross-sectional configurations, will be disposed at their operational positions internally within the inflated bulk material cargo container liners, however, the inflatable air bag components will be disposed in their deflated states so as to in fact permit a full and complete bulk material cargo load to be charged or loaded into the bulk material cargo container liner. Subsequently, when the bulk material cargo load is to be discharged, unloaded, and exhausted from any one of the bulk material cargo container liners, each one of the vacuum discharge tube assemblies will be fluidically connected to the source of vacuum, not shown, the source of vacuum will be activated, and the bulk cargo material will flow naturally toward each one of the vacuum discharge tube assemblies. At a particular point in time, however, the natural flow of the bulk cargo material toward the vacuum discharge tube assemblies will cease in accordance with the aforenoted gravitational forces acting upon the bulk cargo material, that is, when the angle of repose of the bulk cargo material reaches a particular point or level. At this point in time, the inflatable air bag components can be progressively inflated so as to positively alter or enhance the angle of repose of the bulk cargo material whereby the same can once again flow toward the vacuum discharge tube assemblies so as to be exhausted from the bulk material cargo container liners.

Thus, it may be seen that in accordance with the various principles and teachings of the present invention, there has been disclosed a plurality of new and improved bulk material cargo container liner systems wherein each one of the systems comprises an inflatable bulk material cargo container liner which has at least one inflatable air bag component, and at least one vacuum discharge tube assembly, operatively associated therewith. When the inflatable air bag components are progressively inflated so as to assist the unloading, discharging, and exhausting of the bulk cargo material from the interior of the bulk material cargo container liner, after a portion of the bulk cargo material has been discharged, unloaded, and exhausted in accordance with natural gravitational forces whereby the surface of the bulk cargo material has already attained a particular angle of repose, the angle of repose of the surface of the bulk cargo material will effectively be positively readjusted such that the remaining portion of the bulk cargo material can be discharged, unloaded, and exhausted without necessitating any tilting of the bulk material cargo container and the bulk material cargo container liner disposed therein.

Obviously, many variations and modifications of the present invention are possible in light of the above teachings. It is therefore to be understood that within the scope of the appended claims, the present invention may be practiced otherwise than as specifically described herein.

What is claimed as new and desired to be protected by Letters Patent of the United States of America, is:

1. A bulk material cargo container liner system for disposition within a bulk material cargo container, comprising:

a bulk material cargo container liner, for disposition within a bulk material cargo container, for containing bulk cargo material, and having a substantially rectangular parallelepiped structure when erected whereby said bulk material cargo container liner comprises a front wall surface portion, a pair of side wall surface portions, a top wall surface portion, a bottom wall surface portion, a rear wall surface portion, and a longitudinal axial extent as defined along a longitudinal axis extending between said rear wall surface portion and said front wall surface portion;

at least one vacuum discharge tube member, for discharging the bulk cargo material which is disposed within said bulk material cargo container liner, disposed internally within said bulk material cargo container liner and having a predetermined longitudinal axial extent so as to extend longitudinally rearwardly from a forward internal position within the vicinity of said front wall surface portion of said bulk material cargo container liner toward a bulk material discharge port which is defined within said rear wall surface portion of said bulk material cargo container liner at an elevational level located above said bottom wall surface portion of said bulk material cargo container liner; and at least one inflatable air bag component, operatively associated with said bulk material cargo container liner for causing the bulk cargo material, disposed within said bulk material cargo container liner, to undergo fluid flow transversely, with respect to said longitudinal axis and said longitudinal axial extent of said bulk material cargo container liner, toward said at least one longitudinally oriented vacuum discharge tube member disposed within said bulk material cargo container liner when said at least one inflatable air bag component is inflated from a relatively deflated state to a relatively inflated state so as to facilitate the evacuation of the bulk cargo material from the interior of said bulk material cargo container liner without requiring the tilting of said bulk material cargo container liner.

2. The system as set forth in claim 1, wherein:

said at least one inflatable air bag component is disposed internally within said bulk material cargo container liner.

3. The system as set forth in claim 1, wherein:

said at least one inflatable air bag component is disposed externally of said bulk material cargo container liner.

4. The system as set forth in claim 1, wherein:

said at least one inflatable air bag component has a substantially right-triangular cross-sectional configuration with the hypotenuse portion thereof disposed toward said at least one vacuum discharge tube member.

5. The system as set forth in claim 4, wherein:

said at least one inflatable air bag component comprises a plurality of axially separated compartments each one of which has a substantially right-triangular cross-sectional configuration.

6. The system as set forth in claim 1, wherein:

said at least one inflatable air bag component comprises a plurality of compartments which together define a substantially right-triangular cross-sectional configuration with the hypotenuse portion thereof disposed toward said at least one vacuum discharge tube member.

7. The system as set forth in claim 6, wherein:

each one of said plurality of compartments has a cross-sectional configuration selected from the group comprising substantially circular and substantially semi-circular; and each one of said plurality of compartments is fabricated from a member selected from the group comprising an enclosed balloon and a web member.

8. The system as set forth in claim 1, wherein:

said at least one inflatable air bag component has a substantially circular cross-sectional configuration.

9. The system as set forth in claim 1, wherein:

said at least one vacuum discharge tube member has a cross-sectional configuration which is selected from the group comprising semi-circular and circular.

10. The system as set forth in claim 9, further comprising:

arcuately-shaped cradle means operatively connected to said bulk material cargo container liner for seating said at least one vacuum discharge tube member thereon in order to positionally maintain said at least one vacuum discharge tube member at a predetermined position within said bulk material cargo container liner when said at least one vacuum discharge tube member has a circular cross-sectional configuration.

11. The system as set forth in claim 1, wherein:

said at least one vacuum discharge tube member comprises a single vacuum discharge tube assembly disposed along the axial centerline of said bulk material cargo container liner; and said at least one inflatable air bag component comprises a pair of inflatable air bag components disposed within the oppositely disposed side corner regions of said bulk material cargo container liner so as to cause bulk cargo material to flow from said oppositely disposed side corner regions of said bulk material cargo container liner toward said single vacuum discharge tube assembly disposed along said axial centerline of said bulk material cargo container liner when said pair of inflatable air bag components are inflated.

12. The system as set forth in claim 1, wherein:

said at least one vacuum discharge tube member comprises a pair of vacuum discharge tube assemblies disposed within the oppositely disposed side corner regions of said bulk material cargo container liner; and said at least one inflatable air bag component comprises an inflatable air bag component assembly disposed along the axial centerline of said bulk material cargo container liner so as to cause bulk cargo material to flow from axially central regions of said bulk material cargo container liner toward said pair of vacuum discharge tube assemblies disposed within said oppositely disposed side corner regions of said bulk material cargo container liner when said inflatable air bag component assembly is inflated.

13. The system as set forth in claim 1, wherein:

said at least one vacuum discharge tube member comprises a pair of vacuum discharge tube assemblies disposed within laterally spaced central regions of said bulk material cargo container liner; and said at least one inflatable air bag component comprises a plurality of inflatable air bag component assemblies disposed along the axial centerline of said bulk material cargo container liner and within the oppositely disposed side corner regions of said bulk material cargo container liner so as to cause bulk cargo material to flow from axially central regions of said bulk material cargo container liner, and from said oppositely disposed side corner regions of said bulk material cargo container liner, toward said pair of vacuum discharge tube assemblies disposed within said laterally spaced central regions of said bulk material cargo container liner when said plurality of inflatable air bag component assemblies are inflated.

14. The system as set forth in claim 1, wherein:

said at least one vacuum discharge tube member comprises a vacuum discharge tube assembly comprising a plurality of vacuum discharge tube sections fixedly but separably connected together so as to extend throughout said longitudinal axial extent of said bulk material cargo container liner.

15. The system as set forth in claim 14, further comprising:

means, selected from the group comprising snap-fitting means and clamping means, for fixedly but separably connecting together adjacent end portions of said plurality of vacuum discharge tube sections.

16. The system as set forth in claim 14, further comprising:

means operatively connected to said plurality of vacuum discharge tube sections for adjusting the amount of vacuum suction force which can effectively be impressed upon each one of said vacuum discharge tube sections.

17. The system as set forth in claim 16, wherein:

each one of said vacuum discharge tube sections has a first set of apertures defined within side wall portions thereof so as to fluidically connect the interior portion of said bulk material cargo container liner to the interior portions of said vacuum discharge tube sections; and said means operatively connected to said plurality of vacuum discharge tube sections for adjusting the amount of vacuum suction force which can effectively be impressed upon each one of said vacuum discharge tube sections comprises a strip movably mounted within each one of said vacuum discharge tube sections and comprising a second set of apertures which are to be aligned and misaligned with respect to said first set of apertures defined within said side wall portions of said vacuum discharge tube sections when said strips are moved within each one of said vacuum discharge tube sections between EXTENDED and RETRACTED positions.

18. The system as set forth in claim 16, wherein:

each one of said vacuum discharge tube sections has a first set of apertures defined within side wall portions thereof so as to fluidically connect the interior portion of said bulk material cargo container liner to the interior portions of said vacuum discharge tube sections; and said means operatively connected to said plurality of vacuum discharge tube sections for adjusting the amount of vacuum suction force which can effectively be impressed upon each one of said vacuum discharge tube sections comprises a sleeve member movably mounted within each one of said vacuum discharge tube sections and comprising a second set of apertures which are to be aligned and misaligned with respect to said first set of apertures defined within said side wall portions of said vacuum discharge tube sections when said sleeve members are moved within each one of said vacuum discharge tube sections between EXTENDED and RETRACTED positions.

19. The system as set forth in claim 1, wherein:

said at least one vacuum discharge tube member has a circular cross-sectional configuration; and a coil spring member is disposed internally within said at least one vacuum discharge tube member so as to prevent the internal collapse of said at least one vacuum discharge tube member when said at least one vacuum discharge tube member undergoes any one of flexed, bent, and coiled manipulations.

20. The system as set forth in claim 1, wherein:

said at least one vacuum discharge tube member comprises a plurality of inflatable tubular members disposed within an annular array so as to provide said at least one vacuum discharge tube member with its circular cross-sectional configuration.

21. The system as set forth in claim 1, wherein:

said at least one vacuum discharge tube member comprises a single vacuum discharge tube assembly disposed along the axial centerline of said bulk material cargo container liner; and said at least one inflatable air bag component comprises a plurality of inflatable air bag components disposed within oppositely disposed side corner regions of said bulk material cargo container liner and within a forward end portion of said bulk material cargo container liner so as to cause bulk cargo material to flow from said oppositely disposed side corner regions of said bulk material cargo container liner, and from said forward end portion of said bulk material cargo container liner, toward said single vacuum discharge tube assembly disposed along said axial centerline of said bulk material cargo container liner when said plurality of inflatable air bag components are inflated.

22. The system as set forth in claim 1, wherein:

said at least one vacuum discharge tube member comprises has a single intake port disposed at a central location within said bulk material cargo container liner; and said at least one inflatable air bag component comprises a plurality of inflatable air bag components disposed within oppositely disposed side corner regions of said bulk material cargo container liner and within forward and rearward end portions of said bulk material cargo container liner so as to cause bulk cargo material to flow from said oppositely disposed side corner regions of said bulk material cargo container liner, and from said forward and rearward end portions of said bulk material cargo container liner, toward said single intake port of said vacuum discharge tube assembly when said plurality of inflatable air bag components are inflated.

23. The system as set forth in claim 1, wherein:

said at least one vacuum discharge tube member comprises a vacuum discharge tube assembly having a substantially T-shaped configuration so as to be disposed along the axial centerline of said bulk material cargo container liner as well as transversely across said bulk material cargo container liner; and said at least one inflatable air bag component comprises a plurality of inflatable air bag components disposed within forward and rearward end portions of said bulk material cargo container liner so as to cause bulk cargo material to flow from said forward and rearward end portions of said bulk material cargo container liner toward said T-shaped vacuum discharge tube assembly when said plurality of inflatable air bag components are inflated.

* * * * *

UNITED STATES PATENT AND TRADEMARK OFFICE

CERTIFICATE OF CORRECTION

PATENT NO. : 7,597,525 B2
APPLICATION NO. : 10/800765
DATED : October 6, 2009
INVENTOR(S) : McMahon et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 886 days.

Signed and Sealed this

Twenty-eighth Day of September, 2010

David J. Kappos

David J. Kappos
*Director of the United States Patent and Trademark Office*